US011210941B2

(12) United States Patent
McNew

(10) Patent No.: US 11,210,941 B2
(45) Date of Patent: Dec. 28, 2021

(54) SYSTEMS AND METHODS FOR MITIGATING ANOMALIES IN LANE CHANGE DETECTION

(71) Applicant: Toyota Motor Engineering & Manufacturing North America, Inc., Plano, TX (US)

(72) Inventor: John-Michael McNew, Ann Arbor, MI (US)

(73) Assignee: Toyota Motor Engineering & Manufacturing North America, Inc., Plano, TX (US)

( * ) Notice: Subject to any disclaimer, the term of this patent is extended or adjusted under 35 U.S.C. 154(b) by 135 days.

(21) Appl. No.: 16/692,524

(22) Filed: Nov. 22, 2019

(65) Prior Publication Data

US 2021/0158696 A1 May 27, 2021

(51) Int. Cl.
*G08G 1/056* (2006.01)
*G08G 1/00* (2006.01)

(52) U.S. Cl.
CPC ..... *G08G 1/056* (2013.01); *G08G 1/207* (2013.01)

(58) Field of Classification Search
CPC ..... G08G 1/207
See application file for complete search history.

(56) References Cited

U.S. PATENT DOCUMENTS 6,107,939 A 8/2000 Sorden
6,292,752 B1 9/2001 Franke et al.
6,853,906 B1 2/2005 Michi et al.
9,352,746 B2 5/2016 Fritsch et al.
9,460,624 B2 10/2016 Pandita et al.
10,030,978 B2 7/2018 Vladimerou
10,074,281 B2 9/2018 Pandita et al.
2003/0156015 A1 8/2003 Winner et al.
2007/0043506 A1 2/2007 Mudalige et al.
2009/0212930 A1* 8/2009 Pfeiffer ..... B60T 7/22 340/435
2012/0271540 A1 10/2012 Miksa et al.
2016/0116294 A1 4/2016 Raghu et al.
2018/0122244 A1 5/2018 Mueller
2018/0218612 A1* 8/2018 Arai ..... G08G 1/0129
2019/0100200 A1 4/2019 McNew et al.
2019/0103023 A1 4/2019 McNew et al.
2019/0315374 A1* 10/2019 Oh ..... B60W 50/14

* cited by examiner

*Primary Examiner* — John F Mortell
(74) *Attorney, Agent, or Firm* — Christopher G. Darrow; Darrow Mustafa PC

(57) ABSTRACT

System, methods, and other embodiments described herein relate to improving detection of lane changes for an ego vehicle. In one embodiment, a method includes, in response to detecting a surrounding vehicle from sensor data acquired about the surrounding environment by the ego vehicle, estimating a relative position of the surrounding vehicle in relation to the ego vehicle. The method includes determining a context of the surrounding vehicle in relation to a present roadway on which the ego vehicle is traveling. The method includes selectively grouping the surrounding vehicle into a change group according to the context. The change group including one or more vehicles for assessing movements of the ego vehicle. The method includes analyzing relative movements of vehicles in the change group to generate an indicator of whether the ego vehicle has performed a lane change.

20 Claims, 7 Drawing Sheets

SYSTEMS AND METHODS FOR MITIGATING ANOMALIES IN LANE CHANGE DETECTION

TECHNICAL FIELD

The subject matter described herein relates, in general, to mitigating anomalies in a lane change detection system, and, more particularly, to filtering vehicles in areas of common collective movement from consideration when performing lane change detection.

BACKGROUND

Vehicles may be equipped with sensors that facilitate perceiving other vehicles, obstacles, pedestrians, and additional aspects of a surrounding environment. For example, a vehicle may be equipped with a light detection and ranging (LIDAR) sensor that uses light to scan the surrounding environment, while logic associated with the LIDAR analyzes acquired data to detect a presence of objects and other features of the surrounding environment. In further examples, additional/alternative sensors such as cameras may be implemented to acquire information about the surrounding environment from which a system derives awareness about aspects of the surrounding environment. This sensor data can be useful in various circumstances for improving perceptions of the surrounding environment so that systems can perceive the noted aspects and accurately perform associated functions.

In general, the further awareness is developed by the vehicle about a surrounding environment, the better a driver can be supplemented with information to assist in driving and/or the better an autonomous system can control the vehicle to avoid hazards. However, the sensor data acquired by the various sensors generally includes some amount of error. Thus, intrinsically trusting individual identifications of vehicles using a single observation, for example, can result in false detections and misleading information provided to the driver and/or autonomous systems.

In the context of lane identification, observations of a surrounding environment by sensors of the vehicle may be used to identify lanes for lane-keeping functions, lane changes, and other autonomous/warning operations. However, as lane markings vary in quality and type, identifying lanes and correlating lanes with observed vehicles represents a unique difficulty. That is, determining whether a surrounding vehicle is traveling within a particular lane can compound difficulties associated with interpreting sensor data for ensuring accurate detection of a vehicle, determining a precise location of the vehicle, detecting boundaries of lanes, and so on.

To further complicate circumstances, complex road structures such as on-ramps, off-ramps, parallel/proximate roadways, and so on can cause false detections for derived determinations such as lane changes. For example, where a system generally uses collective movements along the roadway to identify lane changes without reliance on lane markings, an on-ramp where vehicles are consistently and collectively moving onto the roadway may result in a false lane change detection of the ego vehicle thereby leading to errors within the situational awareness of the vehicle. As such, existing systems may encounter difficulties with accurately perceiving lane changes, especially when secondary sources such as accurate lane markings are unavailable and, for example, few vehicles are present from which to track movements.

SUMMARY

Example systems and methods disclosed herein relate to improving detection of lane changes for an ego vehicle. For example, in one approach, an ego vehicle may base determinations about lane changes on perceived relative movements of surrounding vehicles. That is, when the ego vehicle does not perceive adequate lane markers, does not have a comprehensive geometric mapping of the roadway, and/or otherwise improves operation through an additional mechanism for understanding lane position and lane changes, the disclosed approach provides for correlating combined movements of surrounding vehicles to infer movement (i.e., lane changes) of the ego vehicle. However, as previously noted, certain configurations of roadways such as on/off-ramps correspond with collective and consistent movements of vehicles that may result in the system erroneously indicating that the ego vehicle is performing a lane change.

Therefore, in one or more approaches, as presently disclosed, the ego vehicle determines when particular roadway features such as on/off-ramps are present and mitigates the effects of vehicles collectively changing lanes within these locations that can result in anomalies in the determination of ego vehicle lane changes. For example, in one aspect, a disclosed system detects a surrounding vehicle and determines a context of the vehicle. The context generally includes whether the vehicle is located in an area where collective movement of vehicles is likely such as around an on-ramp, an off-ramp, etc. According to the context, the system can filter the vehicle from being considered when determining whether the ego vehicle has performed a lane change, thereby preventing false detections. In a further approach, the disclosed system can assign separate weights to vehicles depending on a particular context/location of the vehicles. For example, the system can filter out vehicles located on off/on-ramps while assigning partials weights (e.g., 0.5) to vehicles within noisy lanes (e.g., merge lanes next to ramps) for consideration when performing lane change detection. In this way, the disclosed systems and methods avoid the noted difficulties and improve the functioning of the ego vehicle through accurate assessments of ego lane changes.

In one embodiment, a lane change system for improving detection of lane changes for an ego vehicle is disclosed. The lane change system includes one or more processors and a memory communicably coupled to the one or more processors. The memory stores an acquisition module including instructions that when executed by the one or more processors cause the one or more processors to, in response to detecting a surrounding vehicle from sensor data acquired about the surrounding environment by the ego vehicle, estimate a relative position of the surrounding vehicle in relation to the ego vehicle. The memory stores a lane module including instructions that when executed by the one or more processors cause the one or more processors to determine a context of the surrounding vehicle in relation to a present roadway on which the ego vehicle is traveling. The lane module includes instructions to selectively group the surrounding vehicle into a change group according to the context. The change group including one or more vehicles for assessing movements of the ego vehicle. The lane module includes instructions to analyze relative movements of the one or more vehicles in the change group to generate an indicator of whether the ego vehicle has performed a lane change.

In one embodiment, a non-transitory computer-readable medium for improving detection of lane changes for an ego vehicle and including instructions that when executed by one or more processors cause the one or more processors to perform one or more functions is disclosed. The instructions include instructions to, in response to detecting one or more surrounding vehicles from sensor data acquired about the surrounding environment by the ego vehicle, estimate relative positions of the surrounding vehicles in relation to the ego vehicle. The instructions include instructions to determine respective contexts of the surrounding vehicles in relation to a present roadway on which the ego vehicle is traveling. The instructions include instructions to analyze relative movements of the one or more surrounding vehicles according to the contexts to generate an indicator of whether the ego vehicle has performed a lane change.

In one embodiment, a method for improving detection of lane changes for an ego vehicle is disclosed. In one embodiment, a method includes, in response to detecting a surrounding vehicle from sensor data acquired about the surrounding environment by the ego vehicle, estimating a relative position of the surrounding vehicle in relation to the ego vehicle. The method includes determining a context of the surrounding vehicle in relation to a present roadway on which the ego vehicle is traveling. The method includes selectively grouping the surrounding vehicle into a change group according to the context. The change group including one or more vehicles for assessing movements of the ego vehicle. The method includes analyzing relative movements of vehicles in the change group to generate an indicator of whether the ego vehicle has performed a lane change.

BRIEF DESCRIPTION OF THE DRAWINGS

The accompanying drawings, which are incorporated in and constitute a part of the specification, illustrate various systems, methods, and other embodiments of the disclosure. It will be appreciated that the illustrated element boundaries (e.g., boxes, groups of boxes, or other shapes) in the figures represent one embodiment of the boundaries. In some embodiments, one element may be designed as multiple elements or multiple elements may be designed as one element. In some embodiments, an element shown as an internal component of another element may be implemented as an external component and vice versa. Furthermore, elements may not be drawn to scale.

DETAILED DESCRIPTION

Figure 1:
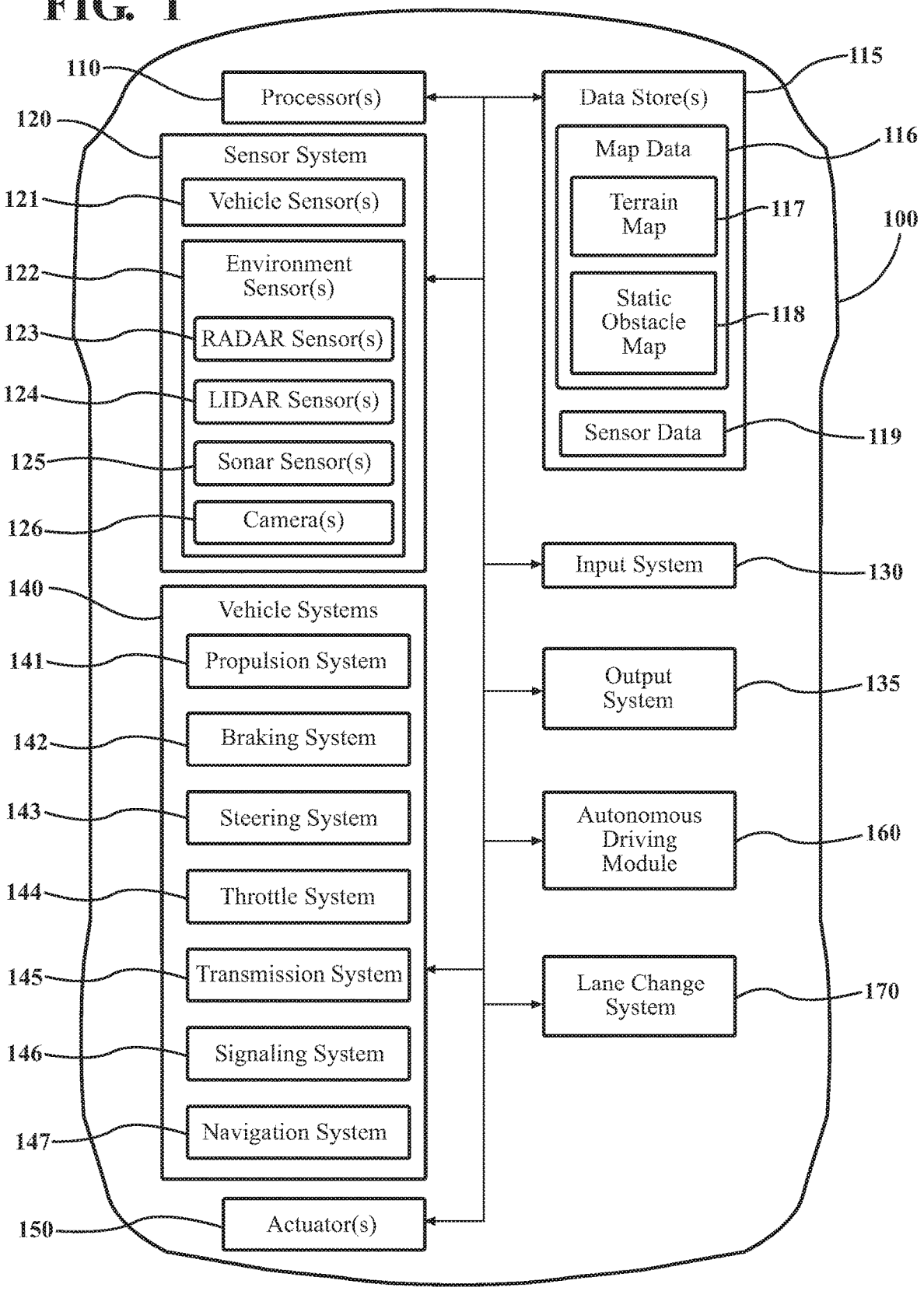
FIG. 1 illustrates one embodiment of a vehicle within which systems and methods disclosed herein may be implemented.

Systems, methods, and other embodiments associated with improving detection of lane changes for an ego vehicle are disclosed. As previously noted, difficulties arise with using perceived relative movements of other vehicles on a roadway to infer lane changes of an ego vehicle when characteristics of a roadway (e.g., on/off ramps) induce collective movement of the surrounding vehicles through, for example, merging behaviors. That is, because many vehicles have corresponding collective movement near on/off-ramps, the ego vehicle may misperceive this movement as its own lane change since such collective movement by many nearby vehicles is otherwise an uncommon occurrence. Thus, when the ego vehicle does not perceive adequate lane markers, does not have a comprehensive geometric mapping of the roadway, and/or otherwise seeks to improve operation through an additional mechanism of understanding lane position/changes, the disclosed approach provides for correlating combined movements of surrounding vehicles to infer movement (i.e., lane changes) of the ego vehicle. However, occurrences of collective movement by other vehicles at particular structures in a roadway can cause difficulties with this approach.

Therefore, in one or more approaches as presently disclosed, the ego vehicle determines when particular roadway features such as on/off-ramps are present. Although the ego vehicle may not have knowledge of the specific geometry of the roadway, the vehicle generally has knowledge of metadata/semantics of the roadway such as a number of lanes, longitudinal locations of on/off-ramps, lateral locations for sides of the ramps, number of lanes on the ramps, and so on. Moreover, the ego vehicle generally estimates a lane position on the roadway according to, for example, monitored tracks of the surrounding vehicles. Thus, through available knowledge and incoming sensor data, the ego vehicle can, in at least one approach, detect surrounding vehicles when approaching a specific roadway feature such as an on/off-ramp and estimate a relative location of the surrounding vehicles.

For example, in one aspect, a disclosed system detects a surrounding vehicle and determines a context of the surrounding vehicle in relation to the roadway feature from the estimated location. The context generally includes whether the vehicle is located on an on-ramp, an off-ramp, a parallel roadway, a merge lane, etc. The system can define different categories within the context such as quiet, noisy, removed, etc. According to the context, the system can determine whether the ego vehicle has performed a lane change while considering the context of the particular surrounding vehicles to facilitate preventing false detections. In one approach, the ego vehicle simply filters/removes vehicles having a context associated with the ramp from any determinations about ego vehicle lane changes. In further aspects, the ego vehicle separately weighs the different contexts depending on a particular probability that vehicles in the context/position are performing lane changes. For example, the system can filter out (e.g., assign a weight of 0) vehicles located on off/on-ramps while assigning partials weights (e.g., 0.5) to vehicles within noisy lanes (e.g., merge lanes next to ramps) for consideration when performing lane change detection. In this way, the disclosed systems and methods avoid the noted difficulties and improve the functioning of the ego vehicle through accurate assessments of ego vehicle lane changes.

Referring to FIG. 1, an example of a vehicle 100 is illustrated. As used herein, a "vehicle" is any form of powered transport. In one or more implementations, the vehicle 100 is an automobile. While arrangements will be described herein with respect to automobiles, it will be understood that embodiments are not limited to automobiles. In some implementations, the vehicle 100 may be any robotic device or form of powered transport that, for example, includes sensors to perceive aspects of the surrounding environment, and thus benefits from the functionality discussed herein to generate relative determinations about lane changes of the vehicle 100. As a further note, this disclosure generally discusses the vehicle 100 as traveling on a roadway with surrounding vehicles, which are intended to be construed in a similar manner as the vehicle 100 itself. That is, the surrounding vehicles can include any vehicle (e.g., motorcycle, tractor-trailer, passenger vehicle, bus, etc.) that may be encountered on a roadway by the vehicle 100.

Additionally, the disclosure further discusses the vehicle 100 as traveling on a roadway that includes multiple lanes. Thus, the present approach to determining lane occupancy and lane changes may be applied to multi-lane roadways (e.g., 2, 3, 4 or more lanes traveling in a single direction) of various configurations. In general, the approach provided herein is characterized by a relative positioning of vehicles in relation to the ego vehicle 100 and an awareness of positions of vehicles in relation to particular roadway features such as merge lanes, on-ramps, off-ramps, etc. and, for example, specific geometric configurations of the roadway may be unknown. Thus, the present approach is applicable in circumstances involving highways and other roadways where similar configurations of merging traffic are present. Moreover, the vehicle 100 is generally referred to herein as the ego vehicle 100 since the disclosed approach is discussed from the perspective of the vehicle 100 developing an awareness of the surrounding environment through acquired sensor data.

The vehicle 100 also includes various elements. It will be understood that in various embodiments, it may not be necessary for the vehicle 100 to have all of the elements shown in FIG. 1. The vehicle 100 can have any combination of the various elements shown in FIG. 1. Further, the vehicle 100 can have additional elements to those shown in FIG. 1. In some arrangements, the vehicle 100 may be implemented without one or more of the elements shown in FIG. 1. While the various elements are shown as being located within the vehicle 100 in FIG. 1, it will be understood that one or more of these elements can be located external to the vehicle 100. Further, the elements shown may be physically separated by large distances.

Some of the possible elements of the vehicle 100 are shown in FIG. 1 and will be described along with subsequent figures. However, a description of many of the elements in FIG. 1 will be provided after the discussion of FIGS. 2-8 for purposes of the brevity of this description. Additionally, it will be appreciated that for simplicity and clarity of illustration, where appropriate, reference numerals have been repeated among the different figures to indicate corresponding or analogous elements. In addition, the discussion outlines numerous specific details to provide a thorough understanding of the embodiments described herein. Those of skill in the art, however, will understand that the embodiments described herein may be practiced using various combinations of these elements.

In either case, the vehicle 100 includes a lane change system 170 that is implemented to perform methods and other functions as disclosed herein relating to detecting surrounding vehicles and contexts of the surrounding vehicles to mitigate anomalies with determinations about lane changes of the ego vehicle 100. The noted functions and methods will become more apparent with a further discussion of the figures.

Figure 2:
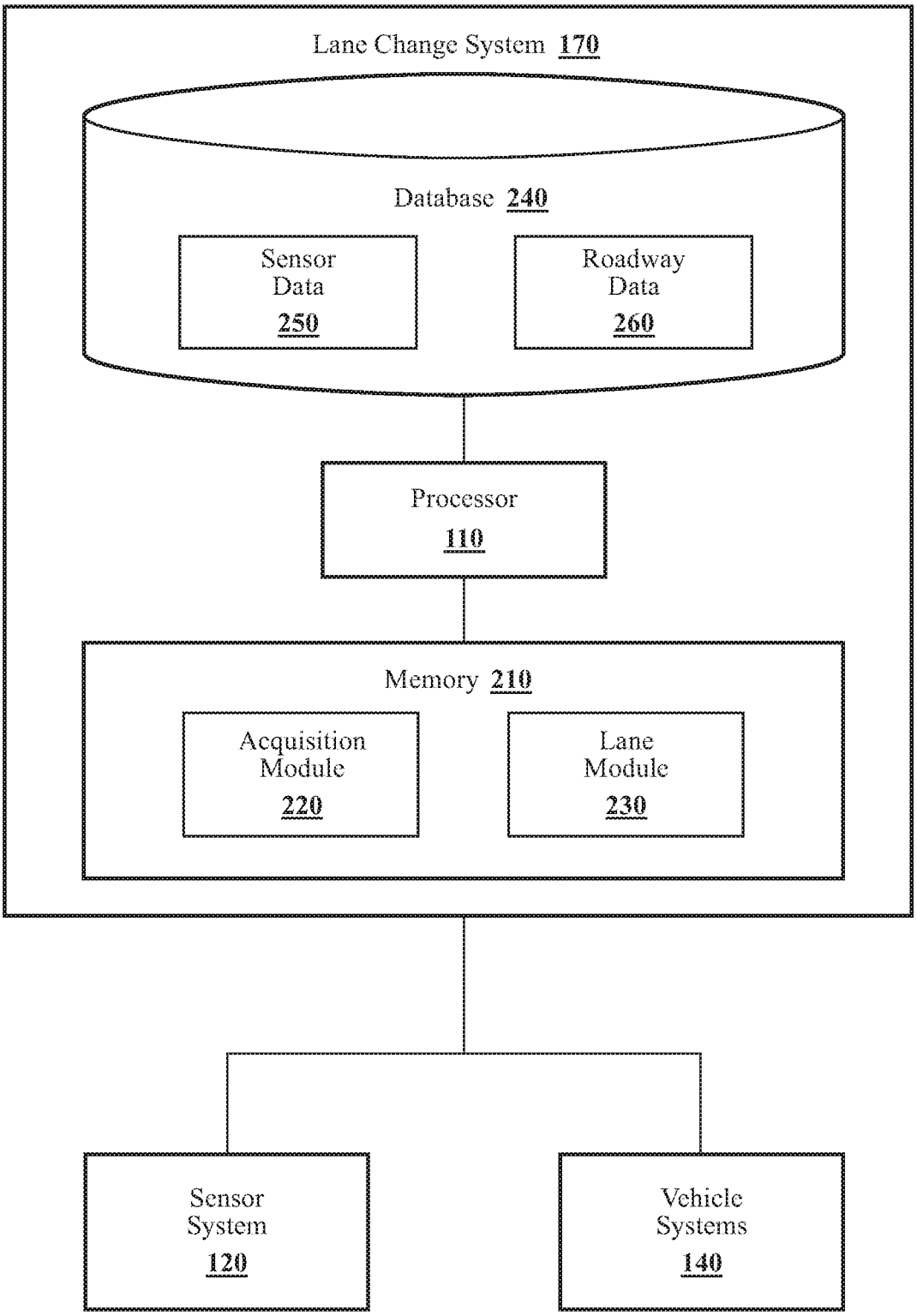
FIG. 2 illustrates one embodiment of a lane change system that is associated with filtering vehicles according to identified contextual relationships.

With reference to FIG. 2, one embodiment of the lane change system 170 of FIG. 1 is further illustrated. The lane change system 170 is shown as including a processor 110 from the vehicle 100 of FIG. 1. Accordingly, the processor 110 may be a part of the lane change system 170, the lane change system 170 may include a separate processor from the processor 110 of the vehicle 100 or the lane change system 170 may access the processor 110 through a data bus or another communication path. In one embodiment, the lane change system 170 includes a memory 210 that stores an acquisition module 220 and a lane module 230. The memory 210 is a random-access memory (RAM), read-only memory (ROM), a hard-disk drive, a flash memory, or other suitable memory for storing the modules 220 and 230. The modules 220 and 230 are, for example, computer-readable instructions that when executed by the processor 110 cause the processor 110 to perform the various functions disclosed herein.

Accordingly, the acquisition module 220 generally includes instructions that function to control the processor 110 to receive or otherwise acquire data inputs from one or more sensors of the vehicle 100 that form sensor data 250, which embodies observations of the surrounding environment of the vehicle 100 including at least surrounding vehicles that may be present. The present discussion will focus on acquiring the sensor data 250 using multiple sensors of the vehicle 100 including, for example, a camera 126. However, it should be appreciated that the disclosed approach can be extended to cover further configurations of sensors such as LiDAR sensors with one or more cameras, different types of LiDARs and cameras, combinations of radars and cameras, sonar, use of a single sensor (e.g., camera), use of sensors of the surrounding vehicles or infrastructure leveraged via vehicle-to-vehicle communications (V2V) or vehicle-to-infrastructure (V2I), and so on.

Accordingly, the acquisition module 220, in one embodiment, controls the respective sensors to provide the data inputs in the form of the sensor data 250. Additionally, while the acquisition module 220 is discussed as controlling the various sensors to provide the sensor data 250, in one or more embodiments, the acquisition module 220 can employ other techniques to acquire the sensor data 250 that are either active or passive. For example, the acquisition module 220 may passively sniff the sensor data 250 from a stream of electronic information provided by the various sensors to further components within the vehicle 100. Moreover, as previously indicated, the acquisition module 220 can undertake various approaches to fuse data from multiple sensors when providing the sensor data 250 and/or from sensor data acquired over a wireless communication link (e.g., v2v) from one or more of the surrounding vehicles. Thus, the sensor data 250, in one embodiment, represents a combination of measurements acquired from multiple sensors.

The sensor data 250 itself generally provides relative measurements between the ego vehicle 100 and the surrounding vehicles from which the acquisition module 220 estimates positions of the surrounding vehicles with respect to, for example, lanes of a roadway and/or other features (e.g., on/off-ramps). The sensor data 250 may also include information (e.g., trajectory) other than the measurements that are used, for example, to identify the surrounding vehicles, and/or other aspects of the surrounding environment. Moreover, the acquisition module 220, in one embodiment, controls the sensors to acquire the sensor data 250 about an area that encompasses 360 degrees about the vehicle 100 in order to provide a comprehensive assessment of the surrounding environment. Of course, in alternative embodiments, the acquisition module 220 may acquire the sensor data about a forward direction alone when, for example, the vehicle 100 is not equipped with further sensors to include additional regions about the vehicle and/or the additional regions are not scanned due to other reasons (e.g., unnecessary due to known current conditions).

Furthermore, in one embodiment, the lane change system 170 includes the data store 240. The data store 240 is, in one embodiment, an electronic data structure (e.g., a database) stored in the memory 210 or another data store and that is configured with routines that can be executed by the processor 110 for analyzing stored data, providing stored data, organizing stored data, and so on. Thus, in one embodiment, the data store 240 stores data used by the modules 220 and 230 in executing various functions. In one embodiment, the data store 240 includes sensor data 250 along with, for example, other information that is used by the modules 220 and 230 such as roadway data 260. Of course, in further embodiments, the data store 240 also stores additional information such as vehicle tracks that indicate prior relative measurements of observed vehicles and interpolated trajectories of those vehicles.

The roadway data 260 generally includes a semantic description of the roadway on which the ego vehicle 100 is traveling. That is, the roadway data 260 indicates information about the roadway such as a number of lanes, locations of on-ramps and off-ramps, numbers of lanes for the ramps, locations of merge lanes, locations of hill-climbing lanes, and so on. Moreover, the locations are generally provided as longitudinal indicators along the roadway (e.g., mile marker), but in further approaches may be specified by GPS information or other suitable locating information.

In either case, the roadway data 260 includes information that describes a general configuration of the roadway. However, the roadway data 260 generally does not include a geometric description beyond a longitudinal position and ramp side designation or a high-definition mapping of the roadway from which particular arrangements of lanes, medians, locations of ramps, and other such aspects of a roadway may be resolved. Thus, the lane change system 170 is generally defined to function without explicit predefined knowledge of lane geometries and functions, in at least one aspect, without knowledge of lane markers. That is, the lane change system 170 infers a current lane of the ego vehicle 100 and lanes of surrounding vehicles via analyzing tracks of the surrounding vehicles over a history of measurements, as will be discussed in greater detail subsequently. In this way, the lane change system 170 can function to identify relative positions and lanes of travel regardless of the presence of lane markers as may occur when markers wear away, are missing, during adverse weather conditions (e.g., snow), and so on.

As a further explanation of the sensor data 250 that is leveraged by the lane module 230 and/or the acquisition module 220 to produce the noted determinations, the sensor data 250 can include 3D point cloud data, camera images, video from the camera 126, radar measurements, and so on. In further embodiments, the sensor data 250 includes information from further sensors (e.g., an IMU) that may be used to perform various tasks (e.g., motion blur correction) in support of the processes noted herein.

The acquisition module 220, in one embodiment, is further configured to perform additional tasks beyond controlling the respective sensors to acquire and provide the sensor data 250. For example, the acquisition module 220 initially analyzes the sensor data 250 to distinguish surrounding vehicles from the surrounding environment (e.g., background, roadway, etc.). In various approaches, the acquisition module 220 employs different object recognition techniques to identify the surrounding vehicles. The particular technique(s) employed to identify the surrounding vehicles may depend on available sensors within the vehicle 100, computational abilities (e.g., processor power) of the vehicle 100, and so on.

In one approach, the acquisition module 220 uses a machine-learning algorithm embedded within the acquisition module 220, such as a convolutional neural network (CNN), to perform semantic segmentation over the sensor data 250 from which the surrounding vehicles are identified and extracted. Of course, in further aspects, the acquisition module 220 may employ different machine-learning algorithms or implements different approaches for performing the semantic segmentation, which can include deep convolutional encoder-decoder architectures, a multi-scale context aggregation approach using dilated convolutions, or another suitable approach that generates semantic labels for the separate object classes represented in the image. Whichever particular approach the acquisition module 220 implements, the acquisition module 220, in one or more embodiments, provides an output identifying the surrounding vehicles represented in the sensor data 250. In this way, the lane change system 170 distinguishes between objects in the surrounding environment and permits the system 170 to perform additional determinations about the separate objects.

Consequently, the acquisition module 220 is generally capable of identifying the surrounding vehicles in order to acquire measurements about relative positions of the surrounding vehicles from the sensor data 250. Thus, by way of example, the acquisition module 220, in one approach, initially acquires the sensor data 250, fuses the sensor data 250 from multiple sensors (i.e., registers and combines information), identifies the surrounding vehicles within the sensor data 250, and then determines measurements to relative positions associated with the surrounding vehicles. The acquisition module 220 determines the measurements by, for example, analyzing the sensor data 250 for each of the surrounding vehicles relative to a center position of the ego vehicle 100. That is, in one approach, the acquisition module 220 measures from a centroid of the vehicle 100 to the surrounding vehicle. Alternatively, the acquisition module 220 measures form a center point of a lane in which the ego vehicle 100 is traveling, a forward edge center point of the ego vehicle 100, a location of a controlling sensor, or another defined point of the ego vehicle 100. In either case, the acquisition module 220 functions to translate the points together into a single reference point or generally uses a single one of the noted points in order to maintain consistency between measurements.

Accordingly, the acquisition module 220 can vary the mechanism of measurement for a particular implementation but provides the measurements as an accurate relative assessment of position in relation to the ego vehicle 100. Additionally, the acquisition module 220 provides, in one embodiment, the measurements from the sensor data 250 for the identified surrounding vehicles. The measurements are, in one embodiment, quantities of distance and direction relative to the measurement point of the ego vehicle 100. Thus, the measurements can be in the form of distance and direction, line quantities (e.g., two endpoints on a 2D plane, etc.), or in another suitable form. In one approach, the measurements are provided in a data structure that maintains a history of measurements (when available) associated with a unique surrounding vehicle. The acquisition module 220 provides an individual measurement as, for example, a struct that stores a timestamp of the measurement, a unique identifier of the surrounding vehicle associated with the measurement, position, and position variance. The precise form of the position can vary according to implementation. In general, the position is provided as a relative 2D position in a plane of the roadway relative to the measurement point of the ego vehicle 100 as previously described. Alternatively, the acquisition module 220 may generate the position as a 3D point relative to the ego vehicle 100 that accounts for changes in elevation.

In either case, the acquisition module 220, in one or more approaches, can store the measurements in a data structure together as a history of positions for each surrounding vehicle. The acquisition module 220 may track the surrounding vehicles in the history of measurements over a relative distance window from the ego vehicle 100. That is, for example, the acquisition module 220 can initially acquire a surrounding vehicle at a distance of 100 meters in front or behind the ego vehicle 100 and generally traveling in a same direction as the ego vehicle 100. Thus, when the surrounding vehicle lapses from this tracking window, the measurements for the surrounding vehicle may be removed from the history, logged, or otherwise no longer considered in the context of lane occupancy determinations. It should be appreciated that while a tracking window of +/−100 m is noted, the particular tracking window implemented by the system 170 may vary according to sensor fidelity, and/or other controlling factors.

As will be discussed in greater detail subsequently, the acquisition module 220 can use the measurements about a surrounding vehicle either in a singular fashion to identify a current estimated relative position in relation to the vehicle 100 or to track the surrounding vehicle and establish particular lane occupancy of the surrounding vehicle and/or the ego vehicle 100. For purposes of the present discussion, the current estimated relative position will be generally referenced since the current location is indicative of whether a surrounding vehicle is presently located within a contextual location (e.g., on/off-ramp) that influences the present determination. However, it should be appreciated that the lane change system 170 can separately or, in combination with an additional system, use the measurement history/tracks to determine a lane of the ego vehicle 100 and the surrounding vehicles through analysis of the tracks with respect to one another over time.

Moreover, with further reference to FIG. 2, in one embodiment, the lane module 230 generally includes instructions that function to control the processor 110 to execute various actions. For example, in one embodiment, the lane module 230 determines a context of the surrounding vehicle(s) from the measurements of the acquisition module 220. The lane module 230, in various implementations, may define the context differently. For example, in one approach, the lane module 230 defines the context in a binary form. That is, the lane module 230 determines whether a surrounding vehicle is located on (i.e., within a boundary of) an on/off-ramp versus simply traveling on the roadway. Thus, when a surrounding vehicle is on the on/off-ramp or another designated area as determined according to the relative estimated position, the lane module 230 populates the context for the surrounding vehicle as remove/removed so as to not consider the surrounding vehicle for the lane change determination. Consequently, the assigned context of the surrounding vehicle can effectively filter the vehicle from consideration.

In a further approach, the lane module 230 defines the context with varying degrees/levels. For example, the lane module 230 may define three separate levels including quiet, noisy, and removed. Quiet generally indicates a lane/region in which a probability of collective movement is unlikely, and thus vehicles having a quiet context are fully considered in the analysis. Noisy generally indicates a lane/region of increased probability of collective movement such as a lane proximate to an on/off ramp, and removed indicates a lane/region of highly increased probability of collective movement such as the on/off ramp itself, merge lanes, lanes that are ending, and so on. Thus, the lane module 230 may assign weights such as 1—quiet, 0.5—noisy, and 0—for removed. Of course, in further implementations, the lane module 230 may define further categories/levels and may assign different weights according to, for example, learned probabilities of a location. In either case, the lane module 230 determines a context of the surrounding vehicle in relation to a present roadway using the relative position with respect to the ego vehicle 100.

Figure 3A:
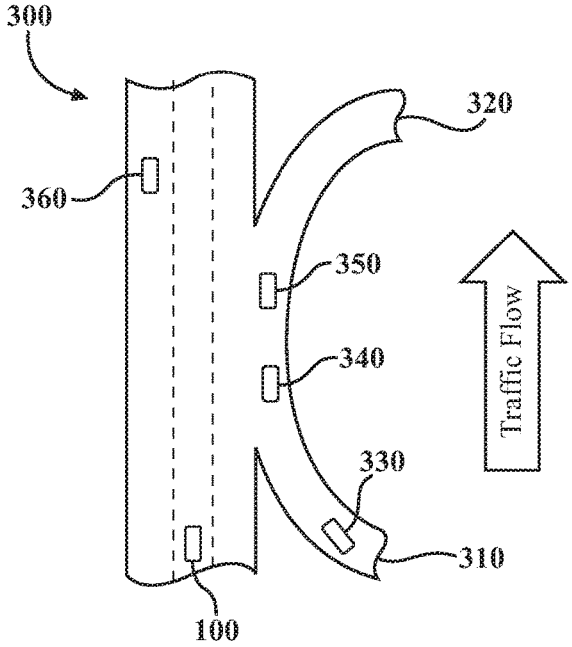
FIG. 3A-D are a collection of diagrams illustrating a roadway and filtered sections of the roadway.
Figure 3B:
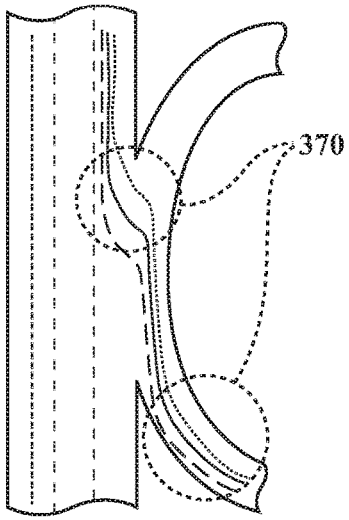
Figure 3C:
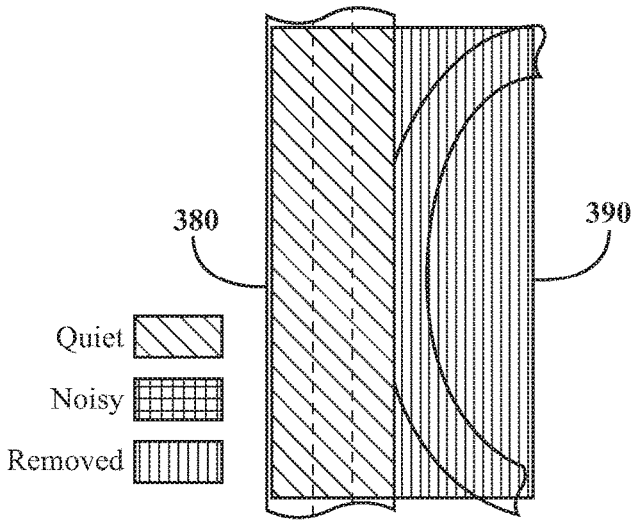
Figure 3D:
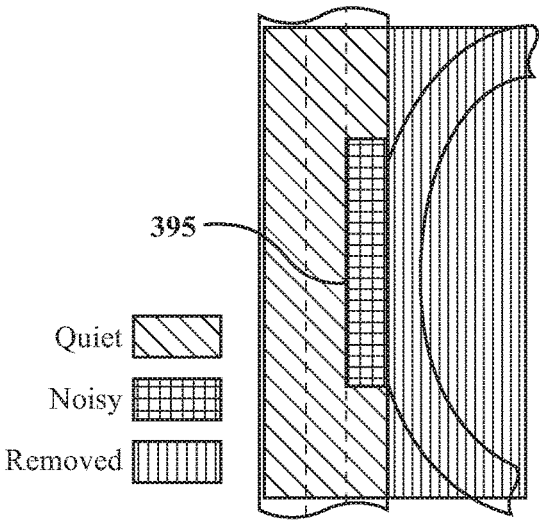

As a further explanation of the context for a surrounding vehicle, consider FIGS. 3A-D, which show four separate illustrations of a roadway 300. The roadway 300 includes an on-ramp 310, an off-ramp 320 and vehicles 330, 340, 350, and 360 in addition to the ego vehicle 100 in FIG. 3A. Thus, as shown in FIG. 3B, paths of the respective vehicles 330, 340, 350, and 360 are illustrated merging onto the roadway 300 from the on-ramp 310. Areas of collective motion 370 are illustrated in FIG. 3B. While the vehicles in FIG. 3A are shown as merging onto the roadway 300, similar collective regions of motion may also be indicated for vehicles that are exiting the roadway onto the off-ramp 320. FIG. 3C illustrates two separate contexts 380 and 390 as may be implemented in the binary context approach discussed previously. FIG. 3D illustrates a weighted example with three separate contexts including an additional noisy region 395 for which the lane module 230 assigns, for example, partial weights (e.g., 0.5).

Figure 4A:
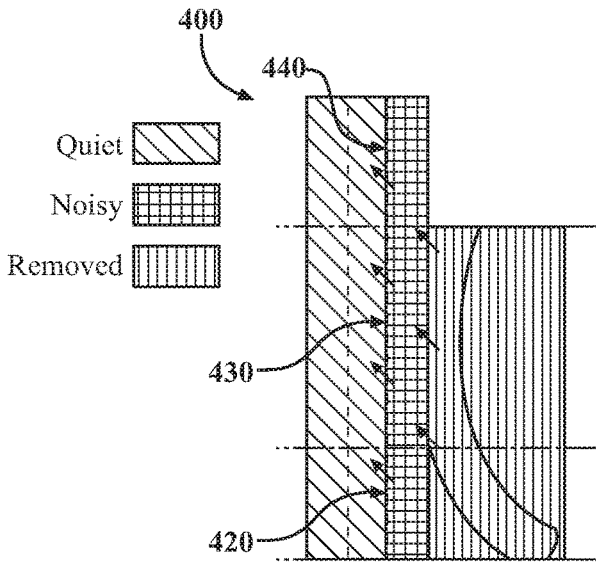
FIG. 4A-B is a diagram illustrating examples of filtered sections of different roadways.
Figure 4B:
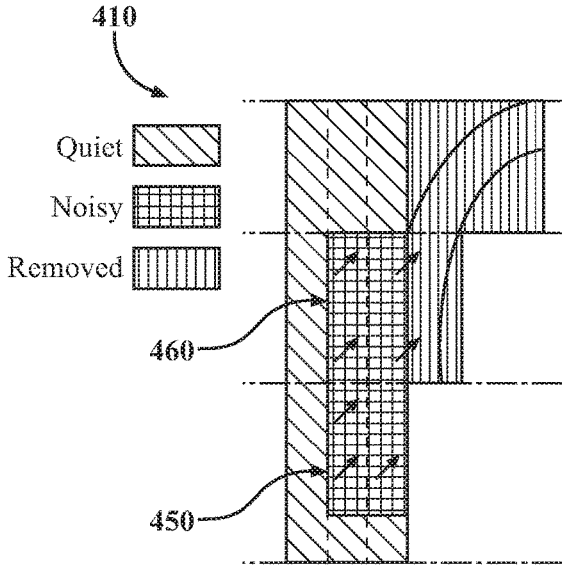
Figure 5:
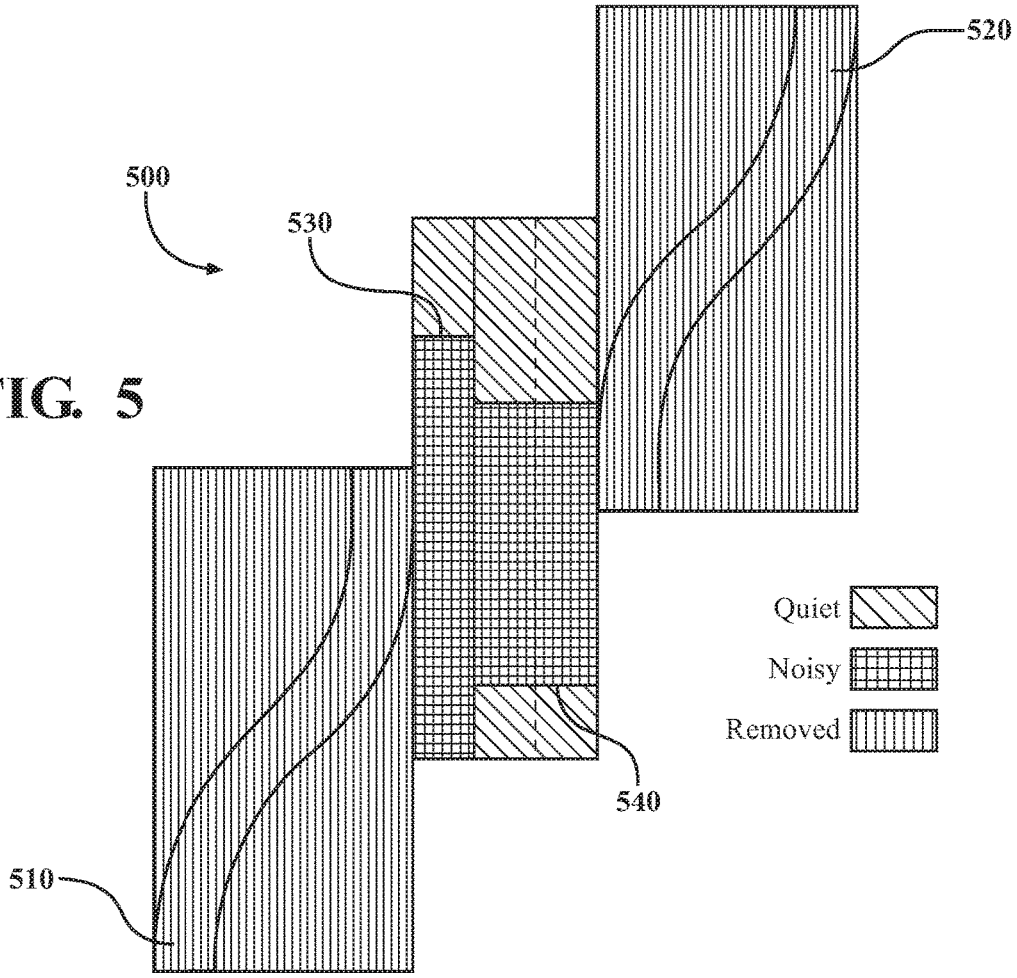
FIG. 5 is a diagram illustrating a roadway with multiple ramps.

Of course, the particular configuration of the contexts may vary depending on implementation and specific road structure. As shown in FIGS. 4A and 4B, weighted contexts for three-lane roadways having an on-ramp 400 and an off-ramp 410 are illustrated. For example, the roadway 400 including the on-ramp weights the whole on-ramp as removed since vehicle motion over the whole ramp is likely to be consistently onto the roadway. However, because of the presence of the ramp, a region 420 prior to the ramp is identified with a noisy context since existing vehicles are likely to merge into a middle lane in anticipation of oncoming traffic. The region 430 is identified as noisy because of vehicles likely merging onto the roadway and likely into further lanes (e.g., middle lanes), while the region 440 is noisy (i.e., partially weighted) because of vehicles that have merged being likely to continue merging to lanes that are further left. In the instance of the off-ramp roadway 410, multiple lanes prior to the off-ramp at 450 are noisy, and lanes proximate to the off-ramp at 460 are noisy due to the higher probability of collective movement toward the off-ramp in those locations. FIG. 5 illustrates a still further example roadway 500 with three lanes that includes a left on-ramp 510 and a right off-ramp 520. As shown, noisy region 530 includes a lead-up area for movement of existing vehicles on the roadway 500 and a merge area for vehicles entering the roadway from the on-ramp 510. The noisy region 540 includes two lanes approaching and parallel with the off-ramp 520. Thus, depending on the configuration of the roadway, the lane module 230 may define the contexts with various arrangements.

Returning to FIG. 2, the lane module 230 selectively groups the surrounding vehicle(s) into a change group according to the context. In one embodiment, the lane module 230 defines the change group to include vehicles that are to be considered when assessing movements of the ego vehicle (i.e., lane changes). Thus, the change group includes, in one embodiment, any surrounding vehicle having an assigned weight other than zero. For example, in the first instance of contexts (e.g., binary), the lane module 230 essentially defines two weights (0 and 1). That is, vehicles traveling on removed segments of roadways (e.g., ramps) are assigned a weight of zero while other vehicles are assigned a weight of one. As such, the lane module 230 effectively filters the vehicles by assigning a weight of zero and thus doesn't consider the vehicles as part of the change group. Similarly, assigning partial weights for contexts having a finer granularity of consideration across roadway configurations selectively adds vehicles to the change group for partial consideration (e.g., noisy lanes).

The lane module 230 then analyzes relative movements of the vehicles in the change group according to the assigned weights for the contexts to determine whether the ego vehicle 100 has performed a lane changed. For example, the lane module 230 correlates perceived collective movement of the surrounding vehicles on the roadway as motion of the ego vehicle itself since all of the observed surrounding vehicles rarely move in concert in the same direction. This approach to inferring the motion of the ego vehicle 100 provides for improved determinations in various circumstances such as when no lane markers are present.

Figure 6A:
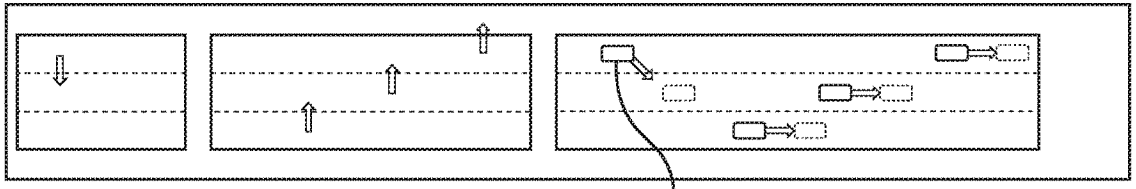
FIG. 6A-D are graphs illustrating the onset of a pressure differential.

To further understand how the lane module 230 infers motion of the ego vehicle from perceived motion of the surrounding vehicles, consider FIG. 6A-D, which illustrates multiple examples of perceived motion of the surrounding vehicles. The example of FIG. 6A illustrates an instance where the lane module 230 detects a true lane change of the ego vehicle 100. As shown in example 6A, the ego vehicle 100 changes lanes while the three surrounding vehicles maintain a forward path of travel. Thus, as perceived by the ego vehicle 100, the surrounding vehicles, in example 6A, all collectively appear to move the left. The lane module 230 interprets this collective movement as a lane change of the ego vehicle 100 itself since such collective movement is otherwise uncommon and typically not synchronized in the same way as perceived when the actual motion is by the ego vehicle 100.

Figure 6B:
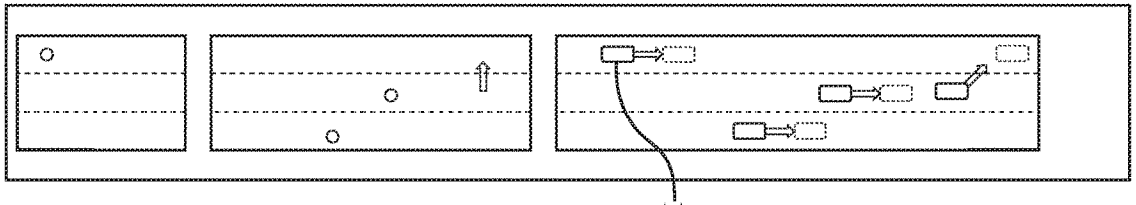
Figure 6C:
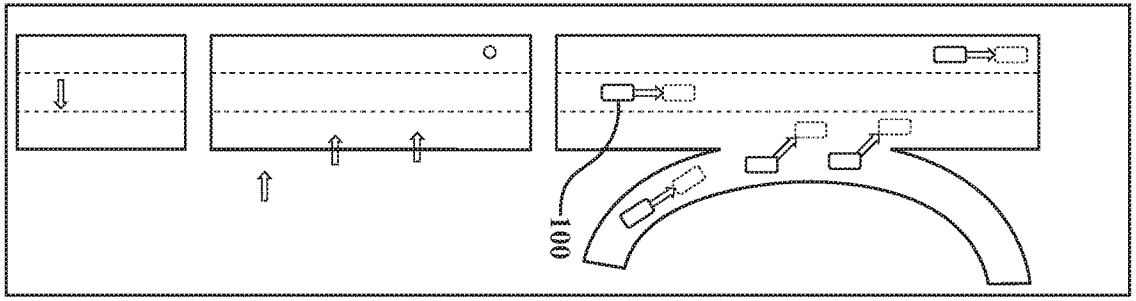

Continuing with FIG. 6B, an instance of a single surrounding vehicle changing lanes to the left while the ego vehicle 100 and other surrounding vehicles continue on a straight line is illustrated. In such a circumstance, the lane module 230 analyzes the motion of the surrounding vehicles and observes the independent movement of a single vehicle as opposed to collective movement. Thus, the lane module 230 infers no lane change for the example of 6B. An example illustrated in FIG. 6C shows a roadway including both an on-ramp and an off-ramp with three vehicles merging onto the roadway from the on-ramp while the ego vehicle 100 continues on a straight path. The ego vehicle 100 perceives the collective movement of the merging vehicles and incorrectly indicates a lane change since, as shown in example 6C, the system 170 is not functioning to identify contexts and selectively group the vehicles. It should be appreciated that if the lane change system 170 did filter the merging vehicles according to the disclosed approach, then the resulting erroneous lane change inference would be avoided.

Figure 6D:
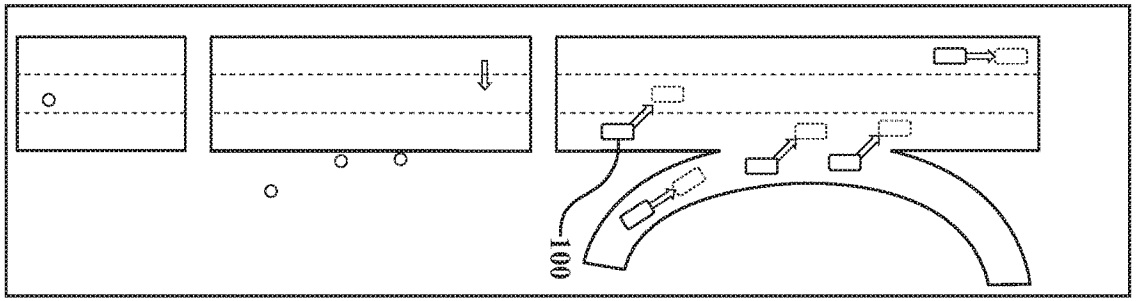

FIG. 6D illustrates another occurrence of an incorrect determination resulting from an on-ramp. As shown in example 6D, the ego-vehicle 100 is changing lanes to the left while three vehicles merge onto the roadway from the on-ramp. Thus, the perceived motion of the merging vehicles by the ego vehicle 100 is that the merging vehicles are, relative to the ego vehicle 100 maintaining a forward trajectory while the single vehicle ahead appears to change lanes to the right. Accordingly, in the instance of example 6D, the collective movement of the merging vehicles nullifies the motion of the lane change of the ego vehicle 100 thereby leading to an incorrect determination that the ego vehicle 100 has not changed lanes. Of course, in the instance of example 6D, if the lane change system 170 was functioning to filter surrounding vehicles from consideration in the lane change analysis, then the lane module 230 would not consider the three merging vehicles and would instead observe the motion of the vehicle ahead to the right and likely accurately infer lane change of the ego vehicle 100.

Figure 7:
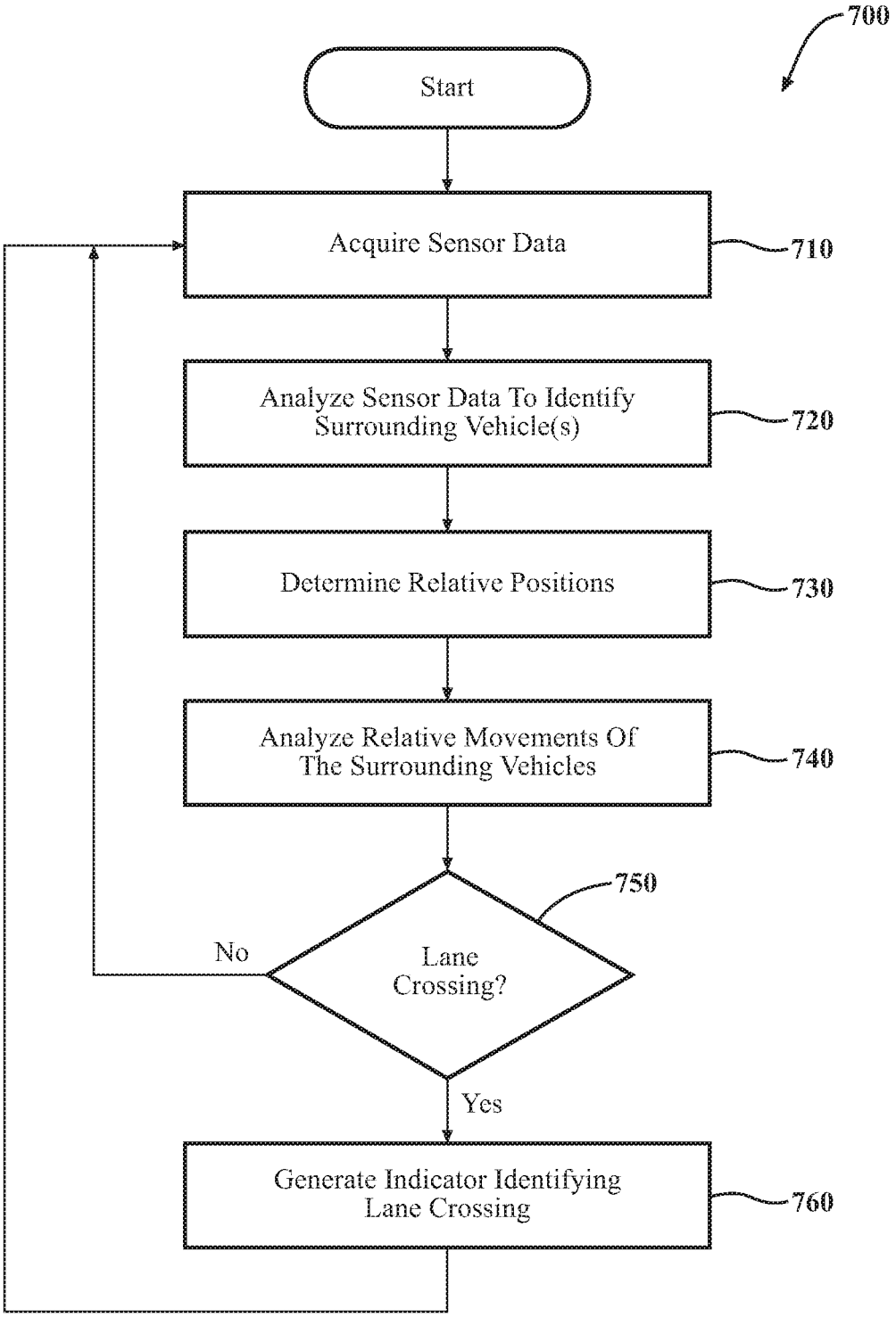
FIG. 7 is a flowchart illustrating one embodiment of a method associated with inferring lane changes of an ego vehicle.

Additional aspects of improving detection of lane changes for an ego vehicle will be discussed in relation to FIG. 7. FIG. 7 illustrates a flowchart of a method 700 that is associated with using relative positions of surrounding vehicles to produce determinations about lane occupancy such as for the ego vehicle 100. The discussion of FIG. 7 is provided as contextual information to further clarify how the disclosed processes of the acquisition module 220 and the lane module 230 may intervene with lane determinations and lane change determinations to improve overall functionality. Method 700 will be discussed from the perspective of the lane change system 170 of FIGS. 1, and 2. While method 700 is discussed in combination with the lane change system 170, it should be appreciated that the method 700 is not limited to being implemented within the lane change system 170 but is instead one example of a system that may implement the method 700.

At 710, the acquisition module 220 controls the sensor system 120 to acquire the sensor data 250. In one embodiment, the acquisition module 220 controls the LiDAR sensor 124 and the camera 126 of the vehicle 100 to observe the surrounding environment. Alternatively, or additionally, the acquisition module 220 controls the camera 126 and the radar 123 or another set of sensors to acquire the sensor data 250. As part of controlling the sensors to acquire the sensor data 250, it is generally understood that the sensors acquire the sensor data 250 of a region around the ego vehicle 100 with data acquired from different types of sensors generally overlapping in order to provide for a comprehensive sampling of the surrounding environment at each time step. In general, the sensor data 250 need not be of the exact same bounded region in the surrounding environment but should include a sufficient area of overlap such that distinct aspects of the area can be correlated. Thus, the acquisition module 220, in one embodiment, controls the sensors to acquire the sensor data 250 of the surrounding environment.

Moreover, in further embodiments, the acquisition module 220 controls the sensors to acquire the sensor data 250 at successive iterations or time steps. Thus, the lane change system 170, in one embodiment, iteratively executes the functions discussed at blocks 310-360 to acquire the sensor data 250 and provide information therefrom. Furthermore, the acquisition module 220, in one embodiment, executes one or more of the noted functions in parallel for separate observations in order to maintain updated perceptions. Additionally, as previously noted, the acquisition module 220, when acquiring data from multiple sensors, fuses the data together to form the sensor data 250 and to provide for improved determinations of detection, location, and so on.

At 720, the acquisition module 220 detects surrounding vehicles traveling on the roadway with the ego vehicle 100. In one embodiment, the acquisition module 220 applies, as previously noted, semantic segmentation or another object recognition routine to the sensor data 250 in order to detect/identify the surrounding vehicle(s). Additionally, while the acquisition module 220 is generally discussed as identifying a single surrounding vehicle, it should be appreciated that the systems and methods disclosed herein perform the noted tasks in parallel for a number "n" of surrounding vehicles that are detected, where "n" is an integer value greater than zero.

Of course, the acquisition module 220 may also identify further features in addition to the surrounding vehicles such as the sky, roads, buildings, lane markings, curbs, sidewalks, signs, posts, trees, and so on. In this way, the lane change system 170 distinguishes between aspects of the surrounding environment to extract the surrounding vehicles. Moreover, the acquisition module 220, in one approach, further employs one or more additional sources such as other vehicles, infrastructure sensors, high-definition maps, and so on to delineate different aspects (e.g., lane markings) of the surrounding environment.

At 730, the acquisition module 220 determines (e.g., estimates) a relative position of the surrounding vehicle detected at 720 in relation to the ego vehicle 100 and, if available, updates vehicle tracks. In one embodiment, as previously discussed, the relative position is determined from a center point of the lane in which the ego vehicle is traveling and relative to a longitudinal location in the lane of the ego vehicle 100. In further aspects, the relative position is determined from a centroid of the ego vehicle 100 or another suitable location. In any case, the acquisition module 220 generally determines the relative position as a measurement to a lateral geometric center of the surrounding vehicle. Thus, the relative position is, for example, generally defined according to a position in a two-dimensional coordinate system with the ego vehicle 100 located at a center thereof.

Additionally, the acquisition module 220 updates a vehicle track for the surrounding vehicle in relation to the ego vehicle 100. In one embodiment, the acquisition module 220 appends the measurement to a measurement history of previous measurements of the surrounding vehicle and adjusts the previous measurements according to the motion of the ego vehicle since a previous update. The acquisition module 220 associates a unique identifier with the surrounding vehicle that facilitates tracking the surrounding vehicle between measurements. In one aspect, the acquisition module 220 updates the history of measurements for the surrounding vehicle(s) according to the motion of the ego vehicle 100 to maintain the relative coordinates. The acquisition module 220 can then generate an updated vehicle track from the updated history. The vehicle track is a parameterization of the measurement history that defines an estimated path of the surrounding vehicle. Thus, the acquisition module 220, in one approach, interpolates the vehicle track according to a spline interpolation or another suitable approach. In this way, the general path of the surrounding vehicle relative to the ego vehicle is defined. Of course, in various instances where the acquisition module 220 has a limited history or otherwise does not further consider tracks of the surrounding vehicles (e.g., only lane change determinations without lane position determinations), the acquisition module 220 may simply determine the relative position without generating tracks or paths.

However, where the lane change system 170 also determines lane positions/occupancy of surrounding vehicles and the ego vehicle 100, at 730, the lane module 230 determines a discrete probability that represents a mean lateral offset for the surrounding vehicle(s) over the vehicle track and according to partitions of the lanes identified by the ego vehicle 100 either directly from observed aspects of the environment or via inference from positioning of the various vehicle tracks including the ego vehicle 100. That is, the lane module 230 determines lateral offsets from, for example, a track of the ego vehicle 100 at corresponding locations along a roadway. In general, the lane module 230 computes the lateral offsets as probability distributions according to, for example, a Gaussian distribution. The lateral offsets are determined between the vehicle tracks of the ego vehicle 100 and the surrounding vehicles. The tracks and thus the lateral offsets over time should generally correlate with the lanes when the vehicles track lanes and are not swerving between lanes.

Accordingly, the lane module 230 uses the lateral offsets over the vehicle track to compute the discrete probability of mean lateral position for the surrounding vehicle. In one embodiment, the lane module 230 uses a form of inverse variance weighting to combine the separate lateral offset distributions into a single discrete probability. In further embodiments, the lane module 230 implements a modified form of Bayesian inference, Kalman filtering, or another suitable approach to generate the discrete probability from the lateral offset distributions for the surrounding vehicle. In either case, the resulting discrete probability represents a mean lateral offset that is a single discrete value for a likely relative position of the surrounding vehicle.

The lane module 230, in one or more embodiments, uses the discrete probabilities to generate position probabilities indicating probable lateral position(s) of the surrounding vehicle(s). That is, the lane module 230 uses the discrete probability in combination with known configurations of the roadway (e.g., number of lanes) on which the vehicles are traveling to determine a likely lane of travel for each of the vehicles including the ego vehicle 100.

In one or more embodiments, at 730, the lane module 230 may further compare the position probability with an occupancy threshold (e.g., minimum probability) to determine whether the position probability indicates to an acceptable degree that a vehicle is occupying an associated one of the surrounding lanes. In either case, the lane change system 170 generally functions at blocks 710-730 to determine relative positions and/or tracks of the vehicles including the ego vehicle 100 according to the available information.

At 740, the lane module 230 analyzes relative movements of the surrounding vehicles. In one embodiment, the lane module 230 determines that the ego vehicle 100 has changed lanes through evidence of collective motion by the surrounding vehicles. That is, where the ego vehicle 100 perceives motion that appears to be coordinated and collective (i.e., all vehicles moving in concert) as in FIG. 6A, the lane module 230 infers the collective motion as a lane change of the ego vehicle 100. In general, the frame of reference of the ego vehicle 100 can be construed as static or stationary in reference to the surrounding environment with objects in the surrounding environment appearing to move even though the ego vehicle 100 itself is potentially the source of the movement relative to the other objects. As such, because the movements of the ego vehicle 100 are then perceived as collective movements of the surrounding vehicles/objects, the system 170 can use this collective movement as evidence of movement by the vehicle 100. Of course, as noted previously, various circumstances arise such as movement in sync with the vehicle 100, collective movement at particular roadway features, etc. that may cause difficulties in the use of such evidence in the lane change determination. In either case, the relative perceived motion of the surrounding vehicles provides additional evidence of actual motion by the ego vehicle 100 that improves overall lane change determinations.

Additionally, the lane module 230 generally analyzes the relative motion via tracked movements of observed points in the environment (i.e., the surrounding vehicles). In one approach, the lane module 230 uses the vehicle tracks comprised of the history of measurements and may specifically review the measurements over a prior defined time window (e.g., 1.0 seconds). In a further aspect, the acquisition module 220 encodes trajectories with the relative measurements to provide determinations of the relative movements. For example, the acquisition module 220, in one approach, encodes the relative position measurements with determinations from radar data that is part of the sensor data 250 in order to provide an indication of the relative motion. Thus, the lane module 230 can then analyze the relative motion for the separate surrounding vehicles to determine when collective motion is present and infer the lane change of the ego vehicle 100.

At 750, the lane module 230 determines whether the relative motion indicates a lane change. In one embodiment, the lane module 230 indicates a lane change for the ego vehicle 100 when, for example, the threshold number of vehicles depict relative motion together. For example, as shown in FIG. 6B, only one of the three surrounding vehicles demonstrate motion. This motion is thus independent and not collective with the other surrounding vehicles. Therefore, as shown in FIG. 6B, the motion is insufficient to indicate a lane change. However, as illustrated in example FIG. 6A, the relative motion of the surrounding vehicles is collective as all of the observed vehicles appear to move left thereby indicating a lane change of the vehicle 100 to the right. In various implementations, the threshold may vary for determining a lane change. For example, in one approach, the system 170 may define the observed number of vehicles for identifying collective motion as a percentage of an observed group (e.g., 75%). In a further approach, the system 170 may define a minimum number of vehicles (e.g., at least two) having collective motion to infer a lane change. In any case, the number/percent of vehicles used to define the threshold generally correlates with a confidence in the determination of a lane change using the present approach and is therefore generally subject to a particular implementation and related constraints.

At 760, the lane module 230 generates an indicator specifying the occurrence of the lane change. In one embodiment, the lane module 230 electronically communicates the indicator over a vehicle bus (e.g., a CAN bus) to various components/systems within the vehicle 100 to update or at least supplement a situational awareness of the components/systems as to a lane position and current maneuvers of the vehicle 100. That is, in at least one approach, the indication of a lane change is applied by the system 170 to update the likelihood of the vehicle traveling in a certain lane. For example, the lane module 230 may provide the indicator specifying a lane change and a direction of the lane change to an autonomous drive module 160, which uses the indication to update path planning and/or other autonomous or semi-autonomous functions. In a further aspect, the lane module 230 uses the indicator to provide an alert to an operator as part of a lane-keeping system. In any case, the lane module 230 can use the indicator to improve overall situational awareness of the vehicle 100 especially in circumstances of low traffic, poor driving conditions (e.g., snow), missing lane markers, and so on.

Figure 8:
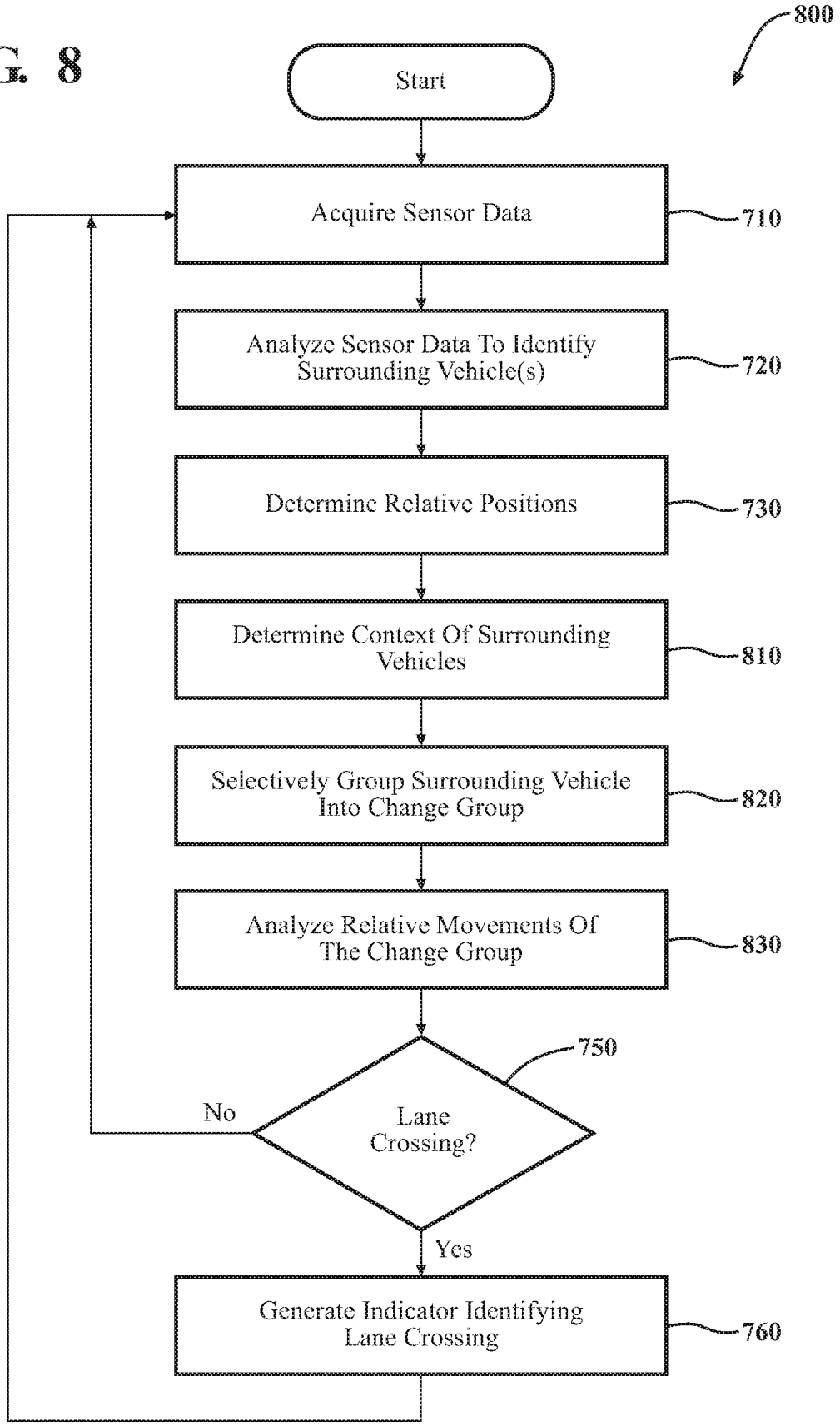
FIG. 8 is a flowchart illustrating one embodiment of a method associated with improving determinations of lane changes by filtering vehicles according to contexts.

Additional aspects of improving detection of lane changes for an ego vehicle will be discussed in relation to FIG. 8. FIG. 8 illustrates a flowchart of a method 800 that is associated with mitigating false lane change detections using the relative motion of surrounding vehicles and awareness about roadway features. FIG. 8 includes various functional blocks that are generally repetitive with method 700, and thus duplicative discussions are omitted for purposes of brevity. Method 800 will be discussed from the perspective of the lane change system 170 of FIGS. 1, and 2. While method 800 is discussed in combination with the lane change system 170, it should be appreciated that the method 800 is not limited to being implemented within the lane change system 170 but is instead one example of a system that may implement the method 700.

As illustrated, the functionality of the acquisition module 220, as discussed in relation to blocks 710, 720, and 730, is generally the same as previously indicated with the discussion of FIG. 7. Accordingly, for purposes of brevity, the discussion will not be repeated.

At 810, the lane module 230 determines a context of the surrounding vehicle(s). In one embodiment, the lane module 230 correlates the estimated relative position as determined at 730 with a known configuration of lanes for the roadway to determine the context. That is, the lane module 230 is generally aware of a lane position of the ego vehicle 100. Thus, the lane module 230, even where a precise geometric configuration of the roadway is unknown, uses the relative position (i.e., distance and angle relative to the ego vehicle 100) to determine a likely location of the surrounding vehicle(s). Thus, the lane module 230, in one approach, uses the number of lanes of the roadway, and the longitudinal location of on/off-ramps to determine a lane position of the surrounding vehicle(s).

As one example, the lane module 230 knows a current lane position of the ego vehicle 100 is lane 2 of a three-lane highway. The lane module 230 is further aware of the number of lanes (i.e., 3) and the location of an on-ramp. As such, the lane module 230 generally knows distances to the various surrounding lanes/ramps according to standard lane widths and known configurations of the roadway. In one approach, the lane module 230 determines a lateral offset of the surrounding vehicle(s) to determine relative lane positions from the measured distances of the surrounding vehicles. In this way, the lane module 230 can assign an estimated position, and thus a context to the different surrounding vehicles as defined according to an association with a particular lane.

In one approach, the lane module 230 uses a defined schema to assign contexts or, alternatively, a defined mapping of the roadway that defines the contexts. For example, the schema may indicate attributes that define lanes and sections of lanes as filtered sections. In various approaches, the schema may define the filtered sections according to a binary filtered/non-filtered definition (e.g., removed versus quiet) where the filtered context correlates with on-ramp/off-ramp lanes, and, in one approach, lanes of proximate separate roadways (e.g., service roads, local roads, etc.). In a separate approach, the schema may define the contexts at a finer granularity and in a partial manner. That is, as previously described in relation to FIGS. 4-5, the schema may define on/off-ramps using a first weight, proximate/merge lanes with a second weight, and other lanes or portions of lanes with a third weight (e.g., removed, noisy, quiet) according to proximities to on/off-ramps. Of course, while three categories are generally discussed in various implementations, the number of categories may be increased to provide a finer granularity of assignments.

In either case, the schema defines the different contexts according to whether vehicles traveling in the associated lanes/regions are to be considered for determinations of lane changes for the ego vehicle 100. Thus, in the case of the binary approach, the schema defines the contexts to associate ramps with vehicles that are removed from consideration. In the instance of a finer granularity of consideration, the schema generally defines ramps as zones to exclude vehicles (e.g., assign a weight of zero), merge lanes/sections of lanes proximate to ramps as zones in which to partially consider vehicles (e.g., assign a weight of 0.5), and remaining lanes/zones as areas to fully consider vehicles (e.g., assign a weight of 1). The schema, in one or more approaches, further defines distances before and after ramps to include within different contexts and a number of adjacent lanes.

It should be appreciated that the schema can define the zones differently for different roadway configurations. For example, the noisy/partially weighted contexts may extend into multiple lanes of a roadway for off-ramps to account for vehicles merging across multiple lanes to reach the off-ramp, as shown in the example 410 of FIG. 4B. Moreover, the noisy/partially weighted contexts may extend to areas of a lane that occur prior to a ramp and/or beyond a ramp, as shown in the example 400 of FIG. 4A. In such a case, the noisy contextual zones are generally accounting for existing vehicles moving over to permit other vehicles to merge onto a roadway and for subsequently merging vehicles to move into further lanes after the ramp. In either case, the schema can define the precise configuration of the separate contextual zones according to a particular configuration of the roadway and in order to account for areas of common collective movement of vehicles that may cause difficulties with the lane change determination of the ego vehicle 100. As previously indicated, in further approaches, the lane module 230 may define the contextual zones (also referred to as filtered sections herein) according to learned behaviors for a particular section of roadway as may be aggregated and analyzed over time through separate observations of vehicles traversing the roadway.

At 820, the lane module 230 selectively groups the surrounding vehicle into a change group according to the context. In general, the change group includes surrounding vehicles of which the lane module 230 references movements to provide determinations of lane changes for the ego vehicle 100. Thus, the lane module 230 may selectively group the surrounding vehicles differently according to a particular approach. That is, the lane module 230 can use the assigned weights associated with assigning contexts to virtually group the vehicles into the change group. For example, assigning a weight of zero effectively removes a vehicle from consideration, and, thus, may serve as a mechanism for filtering vehicles out of the change group. In further examples, the lane module 230 may maintain a separate data structure and actively add, for example, identifiers or other information of vehicles that are included within the change group. In general, the lane module 230 defines the change group as a manner of filtering vehicles that are in an area of common collective movement (i.e., filter sections such as ramps) from consideration in further determinations that may be negatively impacted by such movement.

At 830, which generally parallels the discussion at 740, the lane module 230 analyzes relative movements of the vehicles included within the change group. In one embodiment, as previously specified, the lane module 230 considers present trajectories of the vehicles in order to determine whether the ego vehicle 100 has moved between lanes. In particular, at 830, the lane module 230, in one embodiment, only considers the vehicles that are grouped into the change group and only to an extent defined by respective contexts of the vehicles.

For example, the lane module 230 considers the surrounding vehicles in the change group according to assigned weights that correspond with contextual zones of the particular vehicles. Thus, the lane module 230, in general, provides less weight to vehicles in the noisy lanes as opposed to quiet lanes of travel. Separately weighting the vehicles can provide for avoiding incorrect determinations of lane change while also providing for the ability to provide a determination when few vehicles are available on the roadway.

Upon analyzing the vehicles in the change group, the lane module 230 proceeds with the subsequent analysis at 750 and 760 in the same manner as discussed in relation to method 700 of FIG. 7. However, it should be appreciated, that the additional recognition of contextual positions of the vehicles as considered at 810-830 of method 800 by the lane module 230 provides for improving determinations of lane changes for the ego vehicle 100 especially in circumstances where explicit lane markings are unavailable or otherwise not considered due to weather or other circumstances. As such, the approach discussed in relation to method 800 functions to improve overall situational awareness of the vehicle 100 through the improved awareness of position/movement.

FIG. 1 will now be discussed in full detail as an example environment within which the system and methods disclosed herein may operate. In some instances, the vehicle 100 is configured to switch selectively between an autonomous mode, one or more semi-autonomous operational modes, and/or a manual mode. Such switching can be implemented in a suitable manner. "Manual mode" means that all of or a majority of the navigation and/or maneuvering of the vehicle is performed according to inputs received from a user (e.g., human driver). In one or more arrangements, the vehicle 100 can be a conventional vehicle that is configured to operate in only a manual mode.

In one or more embodiments, the vehicle 100 is an autonomous vehicle. As used herein, "autonomous vehicle" refers to a vehicle that operates in an autonomous mode. "Autonomous mode" refers to navigating and/or maneuvering the vehicle 100 along a travel route using one or more computing systems to control the vehicle 100 with minimal or no input from a human driver. In one or more embodiments, the vehicle 100 is highly automated or completely automated. In one embodiment, the vehicle 100 is configured with one or more semi-autonomous operational modes in which one or more computing systems perform a portion of the navigation and/or maneuvering of the vehicle 100 along a travel route, and a vehicle operator (i.e., driver) provides inputs to the vehicle to perform a portion of the navigation and/or maneuvering of the vehicle 100 along a travel route. Such semi-autonomous operation can include supervisory control as implemented by the lane change system 170 to ensure the vehicle 100 remains within defined state constraints.

The vehicle 100 can include one or more processors 110. In one or more arrangements, the processor(s) 110 can be a main processor of the vehicle 100. For instance, the processor(s) 110 can be an electronic control unit (ECU). The vehicle 100 can include one or more data stores 115 for storing one or more types of data. The data store 115 can include volatile and/or non-volatile memory. Examples of suitable data stores 115 include RAM (Random Access Memory), flash memory, ROM (Read Only Memory), PROM (Programmable Read-Only Memory), EPROM (Erasable Programmable Read-Only Memory), EEPROM (Electrically Erasable Programmable Read-Only Memory), registers, magnetic disks, optical disks, hard drives, or any other suitable storage medium, or any combination thereof. The data store 115 can be a component of the processor(s) 110, or the data store 115 can be operatively connected to the processor(s) 110 for use thereby. The term "operatively connected," as used throughout this description, can include direct or indirect connections, including connections without direct physical contact.

In one or more arrangements, the one or more data stores 115 can include map data 116. The map data 116 can include maps of one or more geographic areas. In some instances, the map data 116 can include information or data on roads, traffic control devices, road markings, structures, features, and/or landmarks in the one or more geographic areas. The map data 116 can be in any suitable form. In some instances, the map data 116 can include aerial views of an area. In some instances, the map data 116 can include ground views of an area, including 360-degree ground views. The map data 116 can include measurements, dimensions, distances, and/or information for one or more items included in the map data 116 and/or relative to other items included in the map data 116. The map data 116 can include a digital map with information about road geometry. The map data 116 can be high quality and/or highly detailed.

In one or more arrangements, the map data 116 can include one or more terrain maps 117. The terrain map(s) 117 can include information about the ground, terrain, roads, surfaces, and/or other features of one or more geographic areas. The terrain map(s) 117 can include elevation data in the one or more geographic areas. The map data 116 can be high quality and/or highly detailed. The terrain map(s) 117 can define one or more ground surfaces, which can include paved roads, unpaved roads, land, and other things that define a ground surface.

In one or more arrangements, the map data 116 can include one or more static obstacle maps 118. The static obstacle map(s) 118 can include information about one or more static obstacles located within one or more geographic areas. A "static obstacle" is a physical object whose position does not change or substantially change over a period of time and/or whose size does not change or substantially change over a period of time. Examples of static obstacles include trees, buildings, curbs, fences, railings, medians, utility poles, statues, monuments, signs, benches, furniture, mailboxes, large rocks, hills. The static obstacles can be objects that extend above ground level. The one or more static obstacles included in the static obstacle map(s) 118 can have location data, size data, dimension data, material data, and/or other data associated with it. The static obstacle map(s) 118 can include measurements, dimensions, distances, and/or information for one or more static obstacles. The static obstacle map(s) 118 can be high quality and/or highly detailed. The static obstacle map(s) 118 can be updated to reflect changes within a mapped area.

The one or more data stores 115 can include sensor data 119. In this context, "sensor data" means any information about the sensors that the vehicle 100 is equipped with, including the capabilities and other information about such sensors. As will be explained below, the vehicle 100 can include the sensor system 120. The sensor data 119 can relate to one or more sensors of the sensor system 120. As an example, in one or more arrangements, the sensor data 119 can include information on one or more LIDAR sensors 124 of the sensor system 120.

In some instances, at least a portion of the map data 116 and/or the sensor data 119 can be located in one or more data stores 115 located onboard the vehicle 100. Alternatively, or in addition, at least a portion of the map data 116 and/or the sensor data 119 can be located in one or more data stores 115 that are located remotely from the vehicle 100.

As noted above, the vehicle 100 can include the sensor system 120. The sensor system 120 can include one or more sensors. "Sensor" means any device, component and/or system that can detect, and/or sense something. The one or more sensors can be configured to detect, and/or sense in real-time. As used herein, the term "real-time" means a level of processing responsiveness that a user or system senses as sufficiently immediate for a particular process or determination to be made, or that enables the processor to keep up with some external process.

In arrangements in which the sensor system 120 includes a plurality of sensors, the sensors can work independently from each other. Alternatively, two or more of the sensors can work in combination with each other. In such a case, the two or more sensors can form a sensor network. The sensor system 120 and/or the one or more sensors can be operatively connected to the processor(s) 110, the data store(s) 115, and/or another element of the vehicle 100 (including any of the elements shown in FIG. 1). The sensor system 120 can acquire data of at least a portion of the external environment of the vehicle 100 (e.g., nearby vehicles).

The sensor system 120 can include any suitable type of sensor. Various examples of different types of sensors will be described herein. However, it will be understood that the embodiments are not limited to the particular sensors described. The sensor system 120 can include one or more vehicle sensors 121. The vehicle sensor(s) 121 can detect, determine, and/or sense information about the vehicle 100 itself. In one or more arrangements, the vehicle sensor(s) 121 can be configured to detect, and/or sense position and orientation changes of the vehicle 100, such as, for example, based on inertial acceleration. In one or more arrangements, the vehicle sensor(s) 121 can include one or more accelerometers, one or more gyroscopes, an inertial measurement unit (IMU), a dead-reckoning system, a global navigation satellite system (GNSS), a global positioning system (GPS), a navigation system 147, and/or other suitable sensors. The vehicle sensor(s) 121 can be configured to detect, and/or sense one or more characteristics of the vehicle 100. In one or more arrangements, the vehicle sensor(s) 121 can include a speedometer to determine a current speed of the vehicle 100.

Alternatively, or in addition, the sensor system 120 can include one or more environment sensors 122 configured to acquire, and/or sense driving environment data. "Driving environment data" includes data or information about the external environment in which an autonomous vehicle is located or one or more portions thereof. For example, the one or more environment sensors 122 can be configured to detect, quantify and/or sense obstacles in at least a portion of the external environment of the vehicle 100 and/or information/data about such obstacles. Such obstacles may be stationary objects and/or dynamic objects. The one or more environment sensors 122 can be configured to detect, measure, quantify and/or sense other things in the external environment of the vehicle 100, such as, for example, lane markers, signs, traffic lights, traffic signs, lane lines, crosswalks, curbs proximate the vehicle 100, off-road objects, etc.

Various examples of sensors of the sensor system 120 will be described herein. The example sensors may be part of the one or more environment sensors 122 and/or the one or more vehicle sensors 121. However, it will be understood that the embodiments are not limited to the particular sensors described.

As an example, in one or more arrangements, the sensor system 120 can include one or more radar sensors 123, one or more LIDAR sensors 124, one or more sonar sensors 125, and/or one or more cameras 126. In one or more arrangements, the one or more cameras 126 can be high dynamic range (HDR) cameras or infrared (IR) cameras.

The vehicle 100 can include an input system 130. An "input system" includes any device, component, system, element or arrangement or groups thereof that enable information/data to be entered into a machine. The input system 130 can receive an input from a vehicle passenger (e.g., a driver or a passenger). The vehicle 100 can include an output system 135. An "output system" includes any device, component, or arrangement or groups thereof that enable information/data to be presented to a vehicle passenger (e.g., a person, a vehicle passenger, etc.).

The vehicle 100 can include one or more vehicle systems 140. Various examples of the one or more vehicle systems 140 are shown in FIG. 1. However, the vehicle 100 can include more, fewer, or different vehicle systems. It should be appreciated that although particular vehicle systems are separately defined, each or any of the systems or portions thereof may be otherwise combined or segregated via hardware and/or software within the vehicle 100. The vehicle 100 can include a propulsion system 141, a braking system 142, a steering system 143, throttle system 144, a transmission system 145, a signaling system 146, and/or a navigation system 147. Each of these systems can include one or more devices, components, and/or a combination thereof, now known or later developed.

The navigation system 147 can include one or more devices, applications, and/or combinations thereof, now known or later developed, configured to determine the geographic location of the vehicle 100 and/or to determine a travel route for the vehicle 100. The navigation system 147 can include one or more mapping applications to determine a travel route for the vehicle 100. The navigation system 147 can include a global positioning system, a local positioning system or a geolocation system.

The processor(s) 110, the lane change system 170, and/or the autonomous driving module(s) 160 can be operatively connected to communicate with the various vehicle systems 140 and/or individual components thereof. For example, returning to FIG. 1, the processor(s) 110 and/or the autonomous driving module(s) 160 can be in communication to send and/or receive information from the various vehicle systems 140 to control the movement, speed, maneuvering, heading, direction, etc. of the vehicle 100. The processor(s) 110, the lane change system 170, and/or the autonomous driving module(s) 160 may control some or all of these vehicle systems 140 and, thus, may be partially or fully autonomous.

The processor(s) 110, the lane change system 170, and/or the autonomous driving module(s) 160 can be operatively connected to communicate with the various vehicle systems 140 and/or individual components thereof. For example, returning to FIG. 1, the processor(s) 110, the lane change system 170, and/or the autonomous driving module(s) 160 can be in communication to send and/or receive information from the various vehicle systems 140 to control the movement, speed, maneuvering, heading, direction, etc. of the vehicle 100. The processor(s) 110, the lane change system 170, and/or the autonomous driving module(s) 160 may control some or all of these vehicle systems 140.

The processor(s) 110, the lane change system 170, and/or the autonomous driving module(s) 160 may be operable to control the navigation and/or maneuvering of the vehicle 100 by controlling one or more of the vehicle systems 140 and/or components thereof. For instance, when operating in an autonomous mode, the processor(s) 110, the lane change system 170, and/or the autonomous driving module(s) 160 can control the direction and/or speed of the vehicle 100.

The processor(s) 110, the lane change system 170, and/or the autonomous driving module(s) 160 can cause the vehicle 100 to accelerate (e.g., by increasing the supply of fuel provided to the engine), decelerate (e.g., by decreasing the supply of fuel to the engine and/or by applying brakes) and/or change direction (e.g., by turning the front two wheels). As used herein, "cause" or "causing" means to make, force, direct, command, instruct, and/or enable an event or action to occur or at least be in a state where such event or action may occur, either in a direct or indirect manner.

The vehicle 100 can include one or more actuators 150. The actuators 150 can be any element or combination of elements operable to modify, adjust and/or alter one or more of the vehicle systems 140 or components thereof to responsive to receiving signals or other inputs from the processor (s) 110 and/or the autonomous driving module(s) 160. Any suitable actuator can be used. For instance, the one or more actuators 150 can include motors, pneumatic actuators, hydraulic pistons, relays, solenoids, and/or piezoelectric actuators, just to name a few possibilities.

The vehicle 100 can include one or more modules, at least some of which are described herein. The modules can be implemented as computer-readable program code that, when executed by a processor 110, implement one or more of the various processes described herein. One or more of the modules can be a component of the processor(s) 110, or one or more of the modules can be executed on and/or distributed among other processing systems to which the processor (s) 110 is operatively connected. The modules can include instructions (e.g., program logic) executable by one or more processor(s) 110. Alternatively, or in addition, one or more data store 115 may contain such instructions.

In one or more arrangements, one or more of the modules described herein can include artificial or computational intelligence elements, e.g., neural network, fuzzy logic or other machine learning algorithms. Further, in one or more arrangements, one or more of the modules can be distributed among a plurality of the modules described herein. In one or more arrangements, two or more of the modules described herein can be combined into a single module.

The vehicle 100 can include one or more autonomous driving modules 160. The autonomous driving module(s) 160 can be configured to receive data from the sensor system 120 and/or any other type of system capable of capturing information relating to the vehicle 100 and/or the external environment of the vehicle 100. In one or more arrangements, the autonomous driving module(s) 160 can use such data to generate one or more driving scene models. The autonomous driving module(s) 160 can determine position and velocity of the vehicle 100. The autonomous driving module(s) 160 can determine the location of obstacles, obstacles, or other environmental features including traffic signs, trees, shrubs, neighboring vehicles, pedestrians, etc.

The autonomous driving module(s) 160 can be configured to receive, and/or determine location information for obstacles within the external environment of the vehicle 100 for use by the processor(s) 110, and/or one or more of the modules described herein to estimate position and orientation of the vehicle 100, vehicle position in global coordinates based on signals from a plurality of satellites, or any other data and/or signals that could be used to determine the current state of the vehicle 100 or determine the position of the vehicle 100 with respect to its environment for use in either creating a map or determining the position of the vehicle 100 in respect to map data.

The autonomous driving module(s) 160 either independently or in combination with the lane change system 170 can be configured to determine travel path(s), current autonomous driving maneuvers for the vehicle 100, future autonomous driving maneuvers and/or modifications to current autonomous driving maneuvers based on data acquired by the sensor system 120, driving scene models, and/or data from any other suitable source such as determinations from the sensor data 250 as implemented by the lane module 230. "Driving maneuver" means one or more actions that affect the movement of a vehicle. Examples of driving maneuvers include: accelerating, decelerating, braking, turning, moving in a lateral direction of the vehicle 100, changing travel lanes, merging into a travel lane, and/or reversing, just to name a few possibilities. The autonomous driving module(s) 160 can be configured to implement determined driving maneuvers. The autonomous driving module(s) 160 can cause, directly or indirectly, such autonomous driving maneuvers to be implemented. As used herein, "cause" or "causing" means to make, command, instruct, and/or enable an event or action to occur or at least be in a state where such event or action may occur, either in a direct or indirect manner. The autonomous driving module(s) 160 can be configured to execute various vehicle functions and/or to transmit data to, receive data from, interact with, and/or control the vehicle 100 or one or more systems thereof (e.g., one or more of vehicle systems 140).

Detailed embodiments are disclosed herein. However, it is to be understood that the disclosed embodiments are intended only as examples. Therefore, specific structural and functional details disclosed herein are not to be interpreted as limiting, but merely as a basis for the claims and as a representative basis for teaching one skilled in the art to variously employ the aspects herein in virtually any appropriately detailed structure. Further, the terms and phrases used herein are not intended to be limiting but rather to provide an understandable description of possible implementations. Various embodiments are shown in FIGS. 1-8, but the embodiments are not limited to the illustrated structure or application.

The flowcharts and block diagrams in the figures illustrate the architecture, functionality, and operation of possible implementations of systems, methods, and computer program products according to various embodiments. In this regard, each block in the flowcharts or block diagrams may represent a module, segment, or portion of code, which comprises one or more executable instructions for implementing the specified logical function(s). It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved.

The systems, components and/or processes described above can be realized in hardware or a combination of hardware and software and can be realized in a centralized fashion in one processing system or in a distributed fashion where different elements are spread across several interconnected processing systems. Any kind of processing system or another apparatus adapted for carrying out the methods described herein is suited. A typical combination of hardware and software can be a processing system with computer-usable program code that, when being loaded and executed, controls the processing system such that it carries out the methods described herein. The systems, components and/or processes also can be embedded in a computer-readable storage, such as a computer program product or other data programs storage device, readable by a machine, tangibly embodying a program of instructions executable by the machine to perform methods and processes described herein. These elements also can be embedded in an application product which comprises all the features enabling the implementation of the methods described herein and, which when loaded in a processing system, is able to carry out these methods.

Furthermore, arrangements described herein may take the form of a computer program product embodied in one or more computer-readable media having computer-readable program code embodied, e.g., stored, thereon. Any combination of one or more computer-readable media may be utilized. The computer-readable medium may be a computer-readable signal medium or a computer-readable storage medium. The phrase "computer-readable storage medium" means a non-transitory storage medium. A computer-readable storage medium may be, for example, but not limited to, an electronic, magnetic, optical, electromagnetic, infrared, or semiconductor system, apparatus, or device, or any suitable combination of the foregoing. More specific examples (a non-exhaustive list) of the computer-readable storage medium would include the following: a portable computer diskette, a hard disk drive (HDD), a solid-state drive (SSD), a read-only memory (ROM), an erasable programmable read-only memory (EPROM or Flash memory), a portable compact disc read-only memory (CD-ROM), a digital versatile disc (DVD), an optical storage device, a magnetic storage device, or any suitable combination of the foregoing. In the context of this document, a computer-readable storage medium may be any tangible medium that can contain, or store a program for use by or in connection with an instruction execution system, apparatus, or device.

Generally, module as used herein includes routines, programs, objects, components, data structures, and so on that perform particular tasks or implement particular data types. In further aspects, a memory generally stores the noted modules. The memory associated with a module may be a buffer or cache embedded within a processor, a RAM, a ROM, a flash memory, or another suitable electronic storage medium. In still further aspects, a module as envisioned by the present disclosure is implemented as an application-specific integrated circuit (ASIC), a hardware component of a system on a chip (SoC), as a programmable logic array (PLA), or as another suitable hardware component that is embedded with a defined configuration set (e.g., instructions) for performing the disclosed functions.

Program code embodied on a computer-readable medium may be transmitted using any appropriate medium, including but not limited to wireless, wireline, optical fiber, cable, RF, etc., or any suitable combination of the foregoing. Computer program code for carrying out operations for aspects of the present arrangements may be written in any combination of one or more programming languages, including an object-oriented programming language such as Java™ Smalltalk, C++ or the like and conventional procedural programming languages, such as the "C" programming language or similar programming languages. The program code may execute entirely on the user's computer, partly on the user's computer, as a stand-alone software package, partly on the user's computer and partly on a remote computer, or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider).

The terms "a" and "an," as used herein, are defined as one or more than one. The term "plurality," as used herein, is defined as two or more than two. The term "another," as used herein, is defined as at least a second or more. The terms "including" and/or "having," as used herein, are defined as comprising (i.e., open language). The phrase "at least one of . . . and . . . " as used herein refers to and encompasses any and all possible combinations of one or more of the associated listed items. As an example, the phrase "at least one of A, B, and C" includes A only, B only, C only, or any combination thereof (e.g., AB, AC, BC or ABC).

Aspects herein can be embodied in other forms without departing from the spirit or essential attributes thereof. Accordingly, reference should be made to the following claims, rather than to the foregoing specification, as indicating the scope hereof.

What is claimed is:

1. A lane change system for improving detection of lane changes for an ego vehicle, comprising:

one or more processors; and a memory communicably coupled to the one or more processors and storing:

an acquisition module including instructions that when executed by the one or more processors cause the one or more processors, in response to detecting a surrounding vehicle from sensor data acquired about a surrounding environment by the ego vehicle, estimate a relative position of the surrounding vehicle in relation to the ego vehicle; and a lane module including instructions that when executed by the one or more processors cause the one or more processors to:

determine a context of the surrounding vehicle in relation to a present roadway on which the ego vehicle is traveling;

selectively group the surrounding vehicle into a change group according to the context, the change group including one or more vehicles for assessing relative movements of the ego vehicle; and analyze the relative movements of the one or more vehicles in the change group to generate an indicator of whether the ego vehicle has performed a lane change without direct knowledge about lanes of the present roadway.

2. The lane change system of claim 1, wherein the lane module includes instructions to determine the context of the surrounding vehicle including instructions to define one or more filtered sections of the present roadway according to whether the present roadway includes one or more of:

an on-ramp to the present roadway, an off-ramp from the present roadway, and a separate parallel roadway that is proximate to the present roadway, and wherein the lane module includes instructions to determine the context including instructions to evaluate the relative position of the surrounding vehicle relative to the ego vehicle including an identified lane position of the ego vehicle.

3. The lane change system of claim 2, wherein the lane module includes instructions to selectively group the surrounding vehicle into the change group including instructions to filter the surrounding vehicle from the change group when the surrounding vehicle is located within one of the filtered sections.

4. The lane change system of claim 1, wherein the lane module includes instructions to determine the context of the surrounding vehicle including instructions to define one or more filtered sections of the present roadway according to whether the present roadway includes an on-ramp to the present roadway, an off-ramp from the present roadway, a separate parallel roadway that is proximate to the present roadway, and at least one merge lane adjacent to the on-ramp or the off-ramp, and wherein the lane module includes instructions to define the one or more filtered sections including instructions to define separate weights to the filtered sections according to an extent to which movements of vehicles in the separate filtered sections are to be considered when generating the indicator.

5. The lane change system of claim 4, wherein the lane module includes instructions to selectively group the surrounding vehicle into the change group including instructions to add the surrounding vehicle to the change group with a weight that is defined according to an assigned one of the filtered sections due to a probability of collective movement, and wherein one of the filtered sections corresponding with the on-ramp and the off-ramp is weighted for no consideration, and one of the filtered sections corresponding with the at least one merge lane is weighted for partial consideration.

6. The lane change system of claim 5, wherein the lane module includes instructions to selectively group the surrounding vehicle into the change group including instructions to assign weights to the filtered sections according to current lane position of the ego vehicle.

7. The lane change system of claim 1, wherein the lane module includes instructions to analyze the relative movements to generate the indicator including instructions to identify perceived collective movements of vehicles in the change group relative to the ego vehicle to determine when the ego vehicle has changed lanes.

8. The lane change system of claim 1, wherein the lane module includes instructions to track relative lane positions of the surrounding vehicle and other vehicles by determining a lateral offset from the ego vehicle at positions along the present roadway.

9. A non-transitory computer-readable medium including instructions that when executed by one or more processors cause the one or more processors to:

in response to detecting one or more surrounding vehicles from sensor data acquired about a surrounding environment by an ego vehicle, estimate relative positions of the surrounding vehicles in relation to the ego vehicle;

determine respective contexts of the surrounding vehicles in relation to a present roadway on which the ego vehicle is traveling; and analyze relative movements of the one or more surrounding vehicles according to the contexts to generate an indicator of whether the ego vehicle has performed a lane change without direct knowledge about lanes of the present roadway.

10. The non-transitory computer-readable medium of claim 9, wherein the instructions to determine the contexts of the one or more surrounding vehicles include instructions to define one or more filtered sections of the present roadway according to whether the present roadway includes one or more of: an on-ramp to the present roadway, an off-ramp from the present roadway, and a separate parallel roadway that is proximate to the present roadway, and wherein the instructions to determine the contexts include instructions to evaluate the relative positions of the one or more surrounding vehicles relative to the ego vehicle including an identified lane position of the ego vehicle.

11. The non-transitory computer-readable medium of claim 10, wherein the instructions to define the one or more filtered sections including instructions to define separate weights to the filtered sections according to an extent to which movements of vehicles in the separate filtered sections are to be considered when generating the indicator.

12. The non-transitory computer-readable medium of claim 9, wherein the instructions to analyze the relative movements to generate the indicator include instructions to identify perceived collective movements of the surrounding vehicles relative to the ego vehicle to determine when the ego vehicle has changed lanes.

13. The non-transitory computer-readable medium of claim 9, wherein the instructions to track relative lane positions of the one or more surrounding vehicles include instructions to determine a lateral offset from the ego vehicle at positions along the present roadway to the one or more surrounding vehicles.

14. A method, comprising:

in response to detecting a surrounding vehicle from sensor data acquired about a surrounding environment by an ego vehicle, estimating a relative position of the surrounding vehicle in relation to the ego vehicle;

determining a context of the surrounding vehicle in relation to a present roadway on which the ego vehicle is traveling;

selectively grouping the surrounding vehicle into a change group according to the context, the change group including one or more vehicles for assessing relative movements of the ego vehicle; and analyzing the relative movements of vehicles in the change group to generate an indicator of whether the ego vehicle has performed a lane change without relying on lane markings of the present roadway.

15. The method of claim 14, wherein determining the context of the surrounding vehicle includes defining one or more filtered sections of the present roadway according to whether the present roadway includes one or more of: an on-ramp to the present roadway, an off-ramp from the present roadway, and a separate parallel roadway that is proximate to the present roadway, and wherein determining the context includes evaluating the relative position of the surrounding vehicle relative to the ego vehicle including an identified lane position of the ego vehicle.

16. The method of claim 15, wherein selectively grouping the surrounding vehicle into the change group includes filtering the surrounding vehicle from the change group when the surrounding vehicle is located within one of the filtered sections.

17. The method of claim 14, wherein determining the context includes defining one or more filtered sections of the present roadway according to whether the present roadway includes an on-ramp to the present roadway, an off-ramp from the present roadway, a separate parallel roadway that is proximate to the present roadway, and at least one merge lane adjacent to the on-ramp or the off-ramp, and wherein defining the one or more filtered sections includes defining separate weights to the filtered sections according to an extent to which movements of vehicles in the separate filtered sections are to be considered when generating the indicator.

18. The method of claim 17, wherein selectively grouping the surrounding vehicle into the change group includes adding the surrounding vehicle to the change group with a weight that is defined according to an assigned one of the filtered sections due to a probability of collective movement, and wherein one of the filtered sections corresponding with the on-ramp and the off-ramp is weighted for no consideration, and one of the filtered sections corresponding with the at least one merge lane is weighted for partial consideration.

19. The method of claim 18, wherein selectively grouping the surrounding vehicle into the change group includes assigning weights to the filtered sections according to a current lane position of the ego vehicle.

20. The method of claim 14, wherein analyzing the relative movements to generate the indicator includes identifying perceived collective movements of vehicles in the change group relative to the ego vehicle to determine when the ego vehicle has changed lanes.

* * * * *